US007394403B2

(12) United States Patent
Winkler et al.

(10) Patent No.: US 7,394,403 B2
(45) Date of Patent: Jul. 1, 2008

(54) EVERYDAY WIRELESS VEHICLE NOTIFICATION AND VEHICLE LOCATION SYSTEMS AND METHODS RELATED THERETO

(75) Inventors: Josef K. Winkler, Wyomissing, PA (US); Vernon L. Stant, Richmond, VA (US); Stephen G. Wilson, Charlottesville, VA (US)

(73) Assignee: Everyday Wireless, LLC, Concord, MA (US)

( * ) Notice: Subject to any disclaimer, the term of this patent is extended or adjusted under 35 U.S.C. 154(b) by 239 days.

(21) Appl. No.: 10/509,172

(22) PCT Filed: Feb. 14, 2003

(86) PCT No.: PCT/US03/04705

§ 371 (c)(1),
(2), (4) Date: Dec. 30, 2005

(87) PCT Pub. No.: WO03/069576

PCT Pub. Date: Aug. 21, 2003

(65) Prior Publication Data

US 2006/0164259 A1 Jul. 27, 2006

Related U.S. Application Data

(60) Provisional application No. 60/357,204, filed on Feb. 14, 2002.

(51) Int. Cl.
*G08G 1/123* (2006.01)

(52) U.S. Cl. ..... 340/994; 340/990; 340/992; 701/204

(58) Field of Classification Search ..... 340/994, 340/988, 989, 991, 992, 993, 425.15, 990; 701/204, 200, 201, 207; 705/9
See application file for complete search history.

(56) References Cited

U.S. PATENT DOCUMENTS

| | | | | |
|---|---|---|---|---|
| 4,799,162 | A * | 1/1989 | Shinkawa et al. | 701/117 |
| 5,183,234 | A * | 2/1993 | Saito | 248/430 |
| 5,657,010 | A * | 8/1997 | Jones | 340/994 |
| 5,724,243 | A | 3/1998 | Westerlage et al. | |
| 5,739,774 | A * | 4/1998 | Olandesi | 340/994 |

(Continued)

FOREIGN PATENT DOCUMENTS

| | | |
|---|---|---|
| GB | 2 178210 A | 2/1987 |

(Continued)

*Primary Examiner*—Toan N. Pham
(74) *Attorney, Agent, or Firm*—Edwards Angell Palmer & Dodge LLP; Peter F. Corless; William J. Daley, Jr.

(57) ABSTRACT

The present invention features a system and methods for notifying passengers of an approaching vehicle. Utilizing such a system and methods, passengers can remain in a safe, controlled environment, avoiding harsh environmental conditions and excessive waiting times, instead arriving at their pick-up point closer and prior to a vehicle's arrival. More specifically, the present invention relates to a bus notification system (100*a*) wherein passengers are able to know the location and estimated arrival time of the bus several minutes before its arrival at a specified location along the bus route. The present invention also features a system and methods for locating an in-transit vehicle and for providing real-time mapping and monitoring of such in-transit vehicles.

18 Claims, 22 Drawing Sheets

U.S. PATENT DOCUMENTS 5,751,245 A * 5/1998 Janky et al. ..... 342/357.07
5,987,377 A * 11/1999 Westerlage et al. ..... 701/204
6,006,159 A 12/1999 Schmier et al.
6,137,425 A * 10/2000 Oster et al. ..... 340/994
6,374,176 B1 * 4/2002 Schmier et al. ..... 701/200
2002/0016668 A1 2/2002 Schaefer

FOREIGN PATENT DOCUMENTS

WO WO 00/63866 10/2000

* cited by examiner

220

*Current bus message coordinates - these are based on time and available to the receiver one a time, depending on the time when the bus send the message.*

| | Lat.Long. 0 (Time 0) | Lat.Long. 1 (Time 1) | Lat.Long. 2 (Time 2) | Lat.Long. 3 (Time 3) | Lat.Long. 4 (Time 4) | Lat.Long. 5 (Time 5) | Lat.Long. 6 (Time 6) | Lat.Long. 7 (Time 7) | Lat.Long. 8 (Time 8) | Predicted ETA |
|---|---|---|---|---|---|---|---|---|---|---|
| Lat.Long. 0 | Dist. 0/0 | Dist. 1/0 | Dist. 2/0 | Dist. 3/0 | Dist. 4/0 | Dist. 5/0 | Dist. 6/0 | Dist. 7/0 | Dist. 8/0 | ETA 0 |
| Lat.Long. 1 | Dist. 0/1 | Dist. 1/1 | Dist. 2/1 | Dist. 3/1 | Dist. 4/1 | Dist. 5/1 | Dist. 6/1 | Dist. 7/1 | Dist. 8/1 | ETA 1 |
| Lat.Long. 2 | Dist. 0/2 | Dist. 1/2 | Dist. 2/2 | Dist. 3/2 | Dist. 4/2 | Dist. 5/2 | Dist. 6/2 | Dist. 7/2 | Dist. 8/2 | ETA 2 |
| Lat.Long. 3 | Dist. 0/3 | Dist. 1/3 | Dist. 2/3 | Dist. 3/3 | Dist. 4/3 | Dist. 5/3 | Dist. 6/3 | Dist. 7/3 | Dist. 8/1 | ETA 3 |
| Lat.Long. 4 | Dist. 0/4 | Dist. 1/4 | Dist. 2/4 | Dist. 3/4 | Dist. 4/4 | Dist. 5/4 | Dist. 6/4 | Dist. 7/4 | Dist. 8/2 | ETA 4 |
| Lat.Long. 5 | Dist. 0/5 | Dist. 1/5 | Dist. 2/5 | Dist. 3/5 | Dist. 4/5 | Dist. 5/5 | Dist. 6/5 | Dist. 7/5 | Dist. 8/3 | ETA 5 |
| Lat.Long. 6 | Dist. 0/6 | Dist. 1/6 | Dist. 2/6 | Dist. 3/6 | Dist. 4/6 | Dist. 5/6 | Dist. 6/6 | Dist. 7/6 | Dist. 8/2 | ETA 6 |
| Lat.Long. 7 | Dist. 0/7 | Dist. 1/7 | Dist. 2/7 | Dist. 3/7 | Dist. 4/7 | Dist. 5/7 | Dist. 6/7 | Dist. 7/7 | Dist. 8/3 | ETA 7 |
| Lat.Long. 8 | Dist. 0/8 | Dist. 1/8 | Dist. 2/8 | Dist. 3/8 | Dist. 4/8 | Dist. 5/8 | Dist. 6/8 | Dist. 7/8 | Dist. 8/4 | ETA 8 |

— windows continue down further —

Learn entries saved in the receiver serial memory. Sinse they have been captured on a previous day, all of this data is available to the microprocessor.

*ETA associated with best fit (shortest distance) row entry*

FIG. 6

EVERYDAY WIRELESS VEHICLE NOTIFICATION AND VEHICLE LOCATION SYSTEMS AND METHODS RELATED THERETO

This application is a 371 of PCT/US03/04705 filed Feb. 14, 2003, which claims the benefit of U.S. Provisional Application Ser. No. 60/357,204 filed Feb. 14, 2002, the teachings of which are incorporated herein by reference in their entirety.

FIELD OF INVENTION

The present invention relates to systems and methods for notifying passengers of an approaching vehicle and more specifically, the present invention relates to a bus notification system that will provide a passenger with adequate warning of an approaching bus well in advance of its arrival at the bus stop. The present invention also relates to systems and methods for monitoring and mapping a transporting vehicle within a predetermined region, and more particularly systems and methods for real-time monitoring and mapping of the transporting vehicle.

BACKGROUND OF THE INVENTION

In many cities and towns, school systems are required to provide transportation to and from school for children living more than a specified distance from school. Generally this transportation is in the form of busing whereby school buses pick up school children at several bus stops along several bus routes and then deliver the children to their school. The arrival time of a school bus at a given bus stop can vary significantly from day to day for any of a number of reasons. As a result, children typically arrive at the bus stop well before the bus is expected to arrive to avoid missing the bus. These children frequently lack parental supervision. Furthermore, on inclement weather days, children waiting for their bus are exposed to harsh weather conditions including rain, snow, or extreme cold. To avoid this situation, concerned parents frequently wait with their children at the bus stop in a car, causing unnecessary pollution.

Buses can be delayed for numerous reasons including inclement weather, such as fog, snow, ice or extreme cold, which reduces the speed of the bus and thus impedes the arrival of the bus at the planned time. Similarly, bus mechanical problems, heavy traffic or substitute bus drivers can generate lengthy delays in bus arrival time. In addition, many school buses will make several sequential runs to pickup children for different schools such as the high, middle and grade schools for a town. A delay in picking up children in the first run can result in similar or longer delays for subsequent runs. Correspondingly, it is possible, when there is good weather and light traffic conditions, for the bus to arrive at the bus stop earlier than the planned time.

In areas where bus routes cover many miles there frequently is a large variance in arrival time of a bus at the bus stops along the route and in many instances the bus stop will not be visible from the home. Similarly in areas where children live closer together, frequently there are communal bus stops for several children such that the bus stop is not visible from the home of each child. Advance notification of bus arrival also allows time to prepare the children for school without rushing to catch the bus.

There are many other situations where passengers and their families might find advance bus notification information useful. Children with special needs will especially benefit from such information, as they will have adequate warning time by which to prepare for boarding of the bus. Additionally, all passengers will be relieved of the shock factor of a bus pulling up unannounced.

In addition the bus, or other transporting vehicle can be become delayed, misrouted, lost or otherwise go off a given travel route after passengers have boarded the bus for any of a number of reasons including the possibility of a driver intentionally departing from the assigned task and travel route for some unexplained reason. Thus, and in some situations, a bus might depart from the assigned travel route or run into vehicle problems after picking up passengers without the dispatching authority becoming aware for sometime afterwards. Because the driver does not provide a warning back to the dispatching authority, such situations are presently identified by someone at the delivery site, for example a school, noticing that a particular bus or vehicle has not arrived well after its expected arrival time or someone notices a bus has broken down and contacts the dispatching authority or police.

In the case where the potential problem is identified by someone noticing that the vehicle has not arrived at the delivery site, the responsible authorities typically dispatch another vehicle or the police to locate the missing vehicle, for example by backtracking along the assigned travel route. In the extreme case, where the driver has for some reason intentionally departed from the travel route, the responsible authorities would not become aware of this particular situation until sometime after an expected arrival time. Also, because of the lack of real-time location information the responsible authorities including the police have to perform a wide area search to track down such a vehicle. Further, there have been instances where a bus has traveled significant distances from the designated travel route before responsible law enforcement authorities caught up with the bus. Thus, in addition to advance notification of the arrival of the vehicle other situations have arisen where location tracking of buses, more particularly real-time tracking and monitoring of buses or other vehicles, would be beneficial for further assurances of passenger safety and would provide a mechanism for tracking down vehicles that are no longer in communication with a dispatcher.

There is disclosed in U.S. Pat. No. 4,325,057 a bus notification system wherein each bus transmitter emits a signal at a unique radio frequency to identify a specific bus. Each receiver is then tuned to the frequency corresponding to said bus transmitter and the length of time between notification and bus arrival is determined by adjusting the receiver's sensitivity control. When the receiver acquires the bus transmission above the predetermined sensitivity threshold the notification system is activated.

Similarly, there is disclosed in U.S. Pat. No. 5,144,301 an alert system using different radio frequencies to identify particular buses and receivers that are tuned to the appropriate radio frequency wherein the time to bus arrival is approximated by comparing the received signal strength to an adjustable threshold setting. When the received signal strength exceeds the threshold, the receiver sequentially activates visual and audio warning signals.

In U.S. Pat. No. 5,021,780, there is disclosed an arrival notification where each bus emits an encoded signal uniquely identifying the bus and receivers in homes along the route are adjusted prior to distribution to receive only the encoded signal transmitted by the bus. The alerting mechanism in the receiver is activated upon detection of the encoded bus transmission using signal strength to estimate arrival time. However, the receiver does not incorporate a method for adjusting the alerting mechanism sensitivity. As a result, there is no available means to control the delay time between notification and bus arrival. Additionally, since the receivers in homes are adjusted prior to distribution, any bus changes or household moves to new buses introduces additional logistics problems.

In these disclosures, the time to bus arrival is approximated by the strength of the bus transmission signal received at the household. Signal strength, however, may not be an accurate measure of distance in every case because obstructions in the wireless radio frequency path can further reduce the signal strength thereby tricking the distance calculation by the receiver. The reduced signal strength can significantly reduce the time period between notification of bus arrival and the actual arrival of said bus. In addition, if the bus route includes several streets that are in close proximity requiring the bus to double back to cover said streets; the possibility for premature notification arises. Further, if two adjacent school districts use the same radio frequency, false alarms and premature notifications can result from two buses in neighboring districts broadcasting the same radio frequency.

A complex advance notification system for alerting passengers when a vehicle is ahead of or behind schedule is disclosed in U.S. Pat. No. 5,400,020. In this system, a vehicle control unit compares the actual time at which the vehicle reaches a predetermined location along the vehicle route against the scheduled arrival time, where the vehicle location is determined by global positioning system (GPS) technology. If there is a discrepancy between the actual and scheduled time values, the vehicle control unit relays the time discrepancy to a base station control unit by wireless communication. The base station control unit notifies each passenger of the change in arrival time by telephone. Thus, arrival time notification only occurs if the vehicle is off schedule. Further, the notification system requires that the telephone line be open and a person present to receive the telephone call. If the passenger is unable to hear the telephone ring such as when the phone is already in use or when the passenger is outside awaiting the arrival of the vehicle, the notification system will fail.

Another complex system for notifying passengers waiting for public transit vehicles of the status of transit vehicles, including expected arrival times of vehicles at transit stops and arrival of connecting transit vehicles is disclosed in U.S. Pat. No. 6,006,159. The disclosed system determines the location of transit vehicles by using a GPS device. The vehicle location is transmitted to a central facility wherein the central processor generates a master transit table for all vehicles calculating scheduled stops, connections to other transit vehicles and arrival times at each scheduled stop. The master transit table is subsequently broadcast to display devices located throughout the geographic area of the transit system including display devices in vehicles and transit stops. The display device stores the transit table or a subset thereof and displays selected information. In addition, the transit table or a subset thereof can be received by portable display means such as pagers, computers or telephones.

This transit notification system is appropriate for city or regional public transportation systems where the system involves a large number of passengers who are traveling between any two transit stops within the transit system and a large number of transit vehicles which are traveling on numerous transit routes within a large geographic area. The central facility must have sufficient resources to process a continuous data feed from each vehicle in the system to form updated transit tables and broadcast the transit table over the entire geographic area of the transit system. This system of notification requires a significant investment of resources in infrastructure development including installation of the central processing center, smart display devices throughout the transit system and vehicle information units in the transit vehicles.

Many passengers predominantly use a transit system to travel between two points such as a commute between home and work. The portable display devices disclosed in this patent are capable of displaying arrival information for a vehicle at a selected vehicle stop, but they can not alert a passenger that a vehicle will arrive at said vehicle stop within a predetermined period of time. Frequently, an automated notification process is desirable to alert the passenger that it is time to start the commute. A device capable of alerting such a commuter of the exact time by which to leave for their commute prior to leaving their controlled environment would be ideal.

In U.S. Pat. No. 5,680,119, there is described a vehicle identification system wherein types of vehicles such as emergency, school bus or other public transportation, delivery or service vehicles with emitters transmit an identifiable signal corresponding to the vehicle type. This patent does not describe a method for identifying a unique vehicle of a particular class, but rather only a method for determining the type of vehicle. Thus, the system merely differentiates between a school bus and an ambulance.

A receiving unit acquiring a RF signal broadcast from a nearby vehicle containing the correct information that is not actually picking up passengers can incorrectly notify passengers of a vehicle arrival at a specified point along the vehicle route. For example, one common passenger pickup technique is to drive all the way to the end of a vehicle route and then commence picking up passengers from the end of the route. This pickup technique poses problems for passengers near the beginning of the route, who are passed by the vehicle traveling in the wrong direction a considerable time before their vehicle actually stops to pick them up. In another example, public transportation vehicles frequently stop at each station in both directions along the vehicle route. Incorporation of a direction of travel parameter into the information transmitted from a vehicle would be especially valuable, allowing a receiving unit to only activate an alert mechanism when receiving a transmission from the correct vehicle traveling in a specified direction.

It thus would be desirable to provide a notification system that can more accurately predict a precise time of vehicle arrival such that a passenger's waiting time for the vehicle is minimized. Such a notification system also should be less complex, less costly and not require extensive infrastructure as compared to prior art systems. Additionally, such systems and particularly the receivers therefore should be inexpensive and not require highly trained individuals to operate the equipment. Further, it would be desirable for such systems and particularly the receivers therefore to be easily adaptable to relocation of the receivers and/or changes in location of vehicles stopping points. Moreover, it would be desirable to provide a real-time monitoring or tracking system whereby the location of vehicles such as buses within a given area can be monitored or tracked in real-time so as to be capable of easily and quickly identifying vehicles that may be in trouble or that have significantly departed from the designated travel route. Also, it would be desirable to provide an integrated system that is capable of providing such notification and such real-time monitoring/tracking capabilities.

SUMMARY OF THE INVENTION

According to one aspect of the present invention, there is featured a vehicle arrival notification system that enables passengers to know the location and arrival time of the transporting vehicle before its arrival at a given location (e.g., many minutes in advance). According to another aspect of the present invention, there also is featured a vehicle locating or tracking system for monitoring and mapping of the location of in-transit transporting vehicles particularly a vehicle locating/tracking system for doing such monitoring and mapping in real-time.

The notification system comprises a transmission apparatus on a vehicle and receiving units at various locations along the vehicle route such as businesses, households, schools, personal vehicles and the like. The transmission apparatus includes subsystems for determining the location of the bus and transmitting a signal including information identifying the vehicle and the current vehicle location. The receiving unit uses the current vehicle location information to determine an estimated time of arrival for the vehicle at a specified location along the vehicle route. More particularly, the receiving unit uses the current vehicle location information with locational information stored in its memory to determine the estimated time of arrival. Preferably, the estimated time of arrival and the distance from the specified location along the vehicle route also is displayed to the passengers or other individuals awaiting the arrival of the transporting vehicle.

The receiving unit also is configured so as to provide either an audio or visual alarm that is activated when the receiving unit determined vehicle arrival time is less than an adjustable time threshold. The alarm function also can work off of a distance threshold, where an adjustable distance trigger is set to activate the alarm. The receiving unit determines the distance between the vehicle and the receiving unit with a simple distance calculation and the alarm is triggered when the calculated distance is less than the threshold.

In a particular application of such a notification system, children and their parents are alerted to the approach of a school bus that is to pick up the children at a school bus stop. The accurate notification of an approaching school bus can minimize if not significantly eliminate the children's wait at the bus stop and consequently their exposure to inclement weather. Children can spend a few extra minutes inside their home with their parents instead of enduring lengthy waits at the bus stop in potentially adverse conditions. In addition to notifying households of an approaching bus picking children up to go to school, the receiver will also alert parents of an approaching school bus that is dropping children off at the end of the school day.

The system includes the means to accurately determine the location of the vehicle and the location of any specified vehicle stop so that the distance between the vehicle and the vehicle stop and the corresponding time can be easily determined. Global positioning satellite (GPS) technology generates extremely accurate location coordinates for the transporting vehicle by analysis of signals from a plurality of global positioning satellites. Receiving units within the range of the transmission apparatus' RF signal receive the GPS determined location of the vehicle regardless of the strength of the RF signal, which is used to determine the location of the vehicle with respect to the location of the vehicle stop. Unlike systems that rely on signal strength to determine the distance and that are subject to inaccuracies resulting from obstructions in the wireless radio frequency path, the methodology for determining vehicle location according to the present invention is independent of signal strength. As a result, a receiving unit can accurately calculate and determine an associated arrival time and the distance between receiving unit and vehicle, thereby providing accurate arrival information. In more specific embodiments of the present invention, the methodology allows the receiving unit to account for changes in estimated time of arrivals caused by, for example, unexpected delays (e.g., delays caused by inclement weather, road construction or accidents) and/or changes in speed of the vehicle.

In particular embodiments, the receiving unit further includes the means to acquire information about a vehicle by an information acquisition protocol herein referred to as the learn function. Activating the learn function when a vehicle approaches the vehicle stop causes the receiving unit to acquire information such as vehicle identification information and vehicle location information from the vehicle transmission unit signal until the vehicle arrives at the vehicle stop proximal the location of the receiving unit. A tabulation of such information is made and stored in the receiver memory. Such data acquisition is made for both the transporting vehicle's pick-up and drop-off.

More specifically, a historical log file that includes a time sequence of vehicle location is stored into the receiver's memory so that this data can be later accessed to understand how the vehicle approaches the vehicle stop proximal the location of the receiver. In specific embodiments the historical log file includes 20 or more minutes of time entries wherein sequential time entries are separated by a small time increment such as 10-30 seconds, more particularly a time interval of about 10 seconds. As a result, the vehicle information acquired by the receiving unit during the learn function is used by the notification system, more particularly each receiving unit of the system along a given travel route, to determine an estimated time of arrival at any given vehicle location on the travel route as well as when to alert passengers that the vehicle is approaching a specific vehicle location/stop.

Additional information is transmitted from the transmitter to the receiving unit at this time, such as time of day information to distinguish AM bus pick-ups from PM bus pick-ups and time of week (e.g., end-of-week) for purposes of conserving battery power of the receiving unit during non-pickup times (e.g., no over weekend pickups).

In another embodiment of the present invention, the transmission apparatus further includes the means to electronically store information about the vehicle during operation. A vehicle log file is generated including an entry for each transmitted RF signal such that each entry includes a time mark and the transmitted vehicle location coordinates. Each vehicle log file entry can further include additional information such as vehicle speed. Information stored in a vehicle log file can be downloaded to a PC for use in monitoring vehicle operation. The information contained in the vehicle log files can be used to monitor vehicle operator performance and to determine the validity of passenger complaints regarding vehicle operation. It also is within the scope of the present invention, to capture the vehicle location information that is being periodically transmitted by a moving vehicle at a centralized location for later analysis and evaluation regarding operator performance as well as vehicle running and dispatching.

According to another aspect of the present invention, one or more receiving units are disposed at designated locations that are particularly configured and arranged to receive the transmitted vehicle location information for all vehicles that are in-transit in a predetermined area at any given time. These one or more receiving units also are configured and arranged so as to store the transmitted vehicle location information so such information can be retrieved later as well as to provide location information on a real-time basis. In more specific embodiments, such receiving units are configured and arranged so as to process and analyze location information as it is being received to determine if an in-transit vehicle is in trouble (e.g., broken down) or has departed the travel route. The receiving unit further provides an output (e.g., warning signal) to notify of such cases.

In a further embodiment, the one or more receiving units are operably coupled to a network infrastructure and arranged so as to form a network of receiving units that collectively receive the transmitted vehicle location information from the vehicles that are in transit in any given area. In this way, at least one of the receiving units will receive the transmitted vehicle location information from a given vehicle regardless of its location within the given area. In addition, this provides a mechanism by which a vehicle that has departed from the designated travel route can be located even though it has departed from the designated travel route.

Each of the receiving units also are configured and arranged so as to process the received vehicle location information and determine if it is the intended recipient of the received information or if this information should be transmitted onto another receiving unit. If it is determined that the information should be forwarded, the receiving unit addresses and forwards the received information to the appropriate receiving unit via the network infrastructure. For example, the receiving unit that has received the vehicle location information determines the IP address for the appropriate receiving unit and forwards the received information to this IP address via the network infrastructure.

In addition to an IF forwarding protocol that can send messages to various parties, data from an antenna going into any networked computer also provides the ability to share information with any remote party. The remote party can be various school personnel working in offices at remote buildings from the base station antenna/computer setup, a bus contractor, or even parents who would want to access a particular bus location for a bus that is getting back late from an extracurricular activity.

Other aspects and embodiments of the invention are discussed below.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein:

FIG. 6 is an exemplary tabulation illustrating an exemplary process for determining an ETA using an exemplary ETA protocol or algorithm;

DESCRIPTION OF THE PREFERRED EMBODIMENT

Figure 1A:
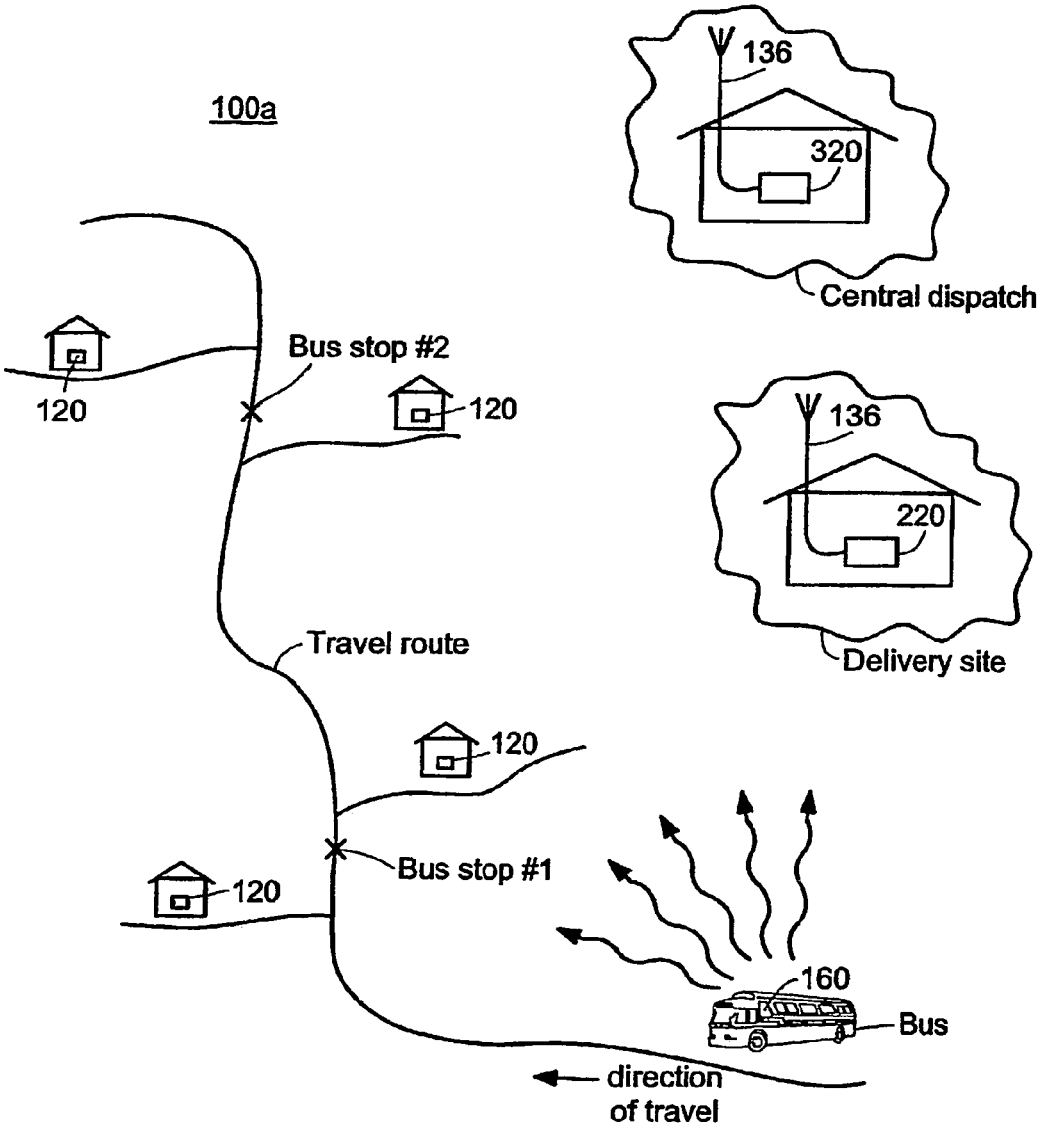
FIG. 1A is an illustrative view of a notification system according to one aspect of the present invention including a receiving unit and a transmission apparatus that is established along a travel path for a transporting vehicle (e.g., bus)

Referring now to the various figures of the drawing wherein like reference characters refer to like parts, there is shown in FIG. 1 an illustrative view of a notification system 100*a* according to the present invention that is established along a travel path for a transporting vehicle (e.g., bus). Such a notification system 100*a* includes a transmission apparatus 160 that is located in a vehicle (e.g., automobile, bus, van, taxi, etc.) and one or more, more particularly a plurality or more, receiving units 120 that are located along the travel route of the vehicle, more particularly located in houses, apartments, households in general, schools, vehicle dispatching locations (e.g., bus dispatch location).

In the particular illustration, two vehicle or bus stops are depicted where two households each having a receiving unit 120 are located proximal each of the bus stops. The depicted number of bus stops and households is for illustration purposes only and the invention is not particularly limited to the illustrative notification system 100*a*. As is more particularly described hereinafter, signals are transmitted from the transmission apparatus 160 in a given vehicle and are received by the receiving units 120 along the travel route for that vehicle. These signals are processed within each receiving unit 120 so as to alert a person when that vehicle is approaching a specified point or stop location on the vehicle's travel route. In the case of the illustrated notification system 100*a*, signals are transmitted from the transmission apparatus 160 on the bus to the two households proximal the first bus stop. The receiving units 120 located in each of these households process these signals as the vehicle approaches and reaches the first bus stop to alert the person(s) in the households of the approaching vehicle. Similarly, the receiving units 120 and each of the two households proximal the second bus stop will process be transmitted signals to provide an indication of the bus approaching the second loss stop.

In addition, such a notification system 100*a* includes a receiving system at each of the one or more destination/delivery sites, for example at each school, to receive signals from the transmission apparatus 160 of each vehicle approaching a given destination/deliver site, which receiving units are hereinafter referred to as a destination/delivery site receiving system 220. These signals are processed within the destination/delivery site receiving system 220 to alert the responsible persons at a given destination/delivery site of an approaching vehicle. For example, in the case of hospital such notification could apprise emergency room personnel of the impending arrival of an ambulance. In the case of a school, such notification would appraise the school's administration of an approaching bus. Although, one destination/delivery site is illustrated this is not a limitation as it well known that a school district/school system can comprise a plurality or more of schools.

Such a notification system 100*a* further includes a receiving and monitoring system 320 that is located at one or more locations, such as a central dispatch location, hospitals and schools. The receiving and monitoring system 320 is configured and arranged to receive signals from the transmission apparatus 160 of each vehicle that is in-transit within a given area. These signals are processed with the receiving and monitoring system 320 receiving such signals and the location information for each vehicle is stored therein for later retrieval and analysis. In specific embodiments, the receiving and monitoring system 320 also is configured and arranged so as to allow real-time analysis of such location information for one or more in-transit vehicles. Further, the receiving and monitoring system is configured and arranged so as to be capable of displaying real-time mapping of one or more in-transit vehicles on a display. As indicated above, it is within the scope of the present invention for a receiving and monitoring system 320 to be located at a destination/delivery site in lieu of the destination/delivery site receiving system 220.

Figure 1B:
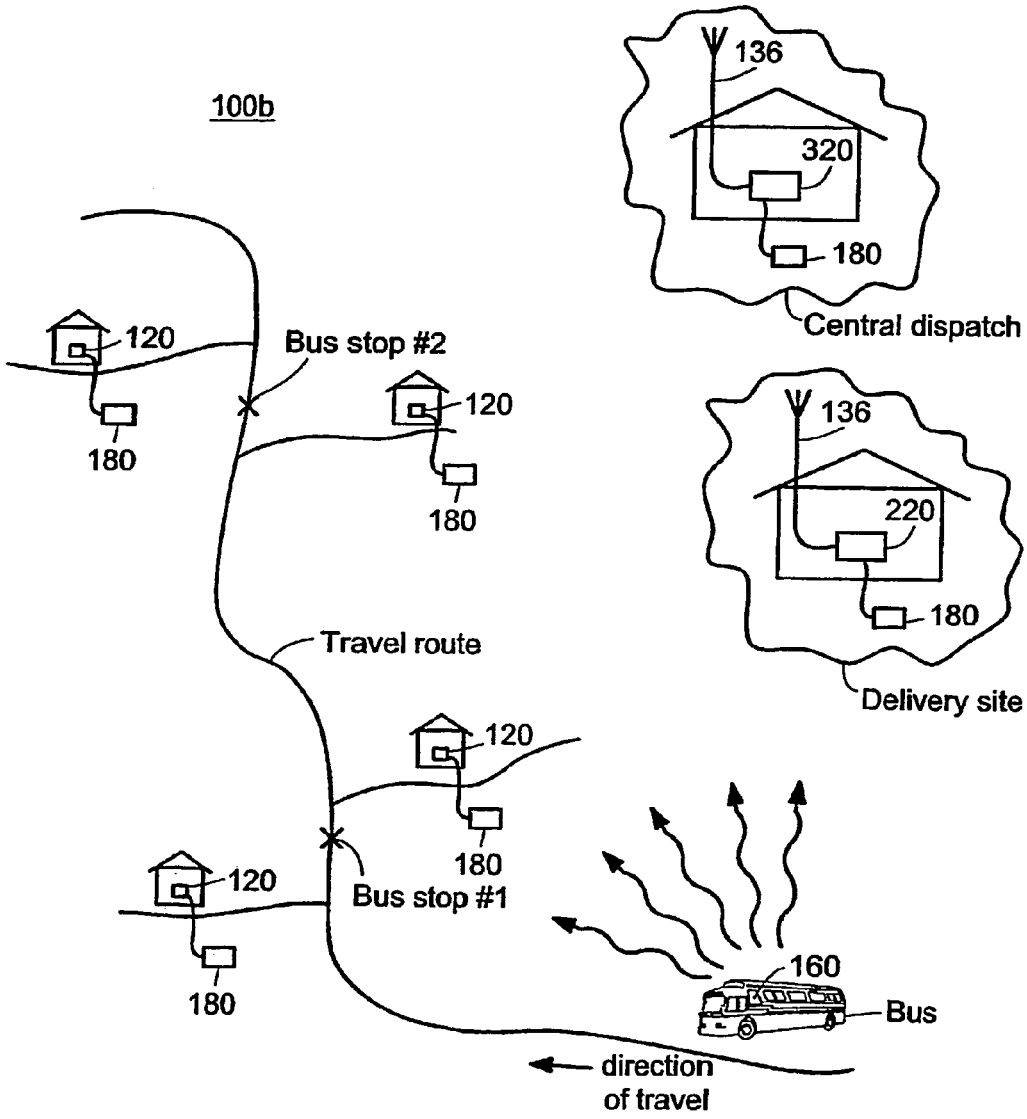
FIG. 1B is an illustrative view of a notification system according to another aspect of the present invention embodying a communications network.

There is shown in FIG. 1B a notification system 100*b* according to another aspect of the present invention where the one or more receiving units 120, the destination/delivery site receiving system 210 and the receiving and monitoring system 320 are each interconnected using any one of a number of communication protocols or techniques to each other so as to form a network. In an illustrative embodiment, the receiving units and the systems 220, 320 are coupled to a communications device or communications link 180 that in turn couples the receiving unit and systems together in accordance with the particular communications technique being employed. For example, the communications link 180 can be a cable modem interconnecting all of the units comprising the network via the Internet so that information being received at any one unit is made available to all of the units comprising the network. The communications network can comprise hard lines, fiber cables and wireless links.

In this way, the effective range of reception for any given unit or system is effectively increased because of the availability of information provided by signals being received by other units or systems comprising a network. This particularly advantageous for the receiving and monitoring system 320 and the destination/delivery site receiving system 220 because location information for the one or more in-transit vehicles is made available to the receiving and monitoring system and/or the destination/delivery system either by direct transmission or via the communications network. This also provides a mechanism to overcome any local RF transmission problems for the notification system.

In the illustrated embodiment, the receiving units 120 in each household, the destination/delivery site receiving system 220 and the receiving and monitoring system 320 are shown as being interconnected to each other. This illustrative embodiment of a notification system according to the present invention, however, shall not be limited to the illustrated embodiment as the network can be made up of any arrangement of one or more of these units/systems 120, 220, 320, such as for example, a network linking the one or more destination/delivery systems 220 to the one or more receiving and monitoring systems 320.

Figure 2A:
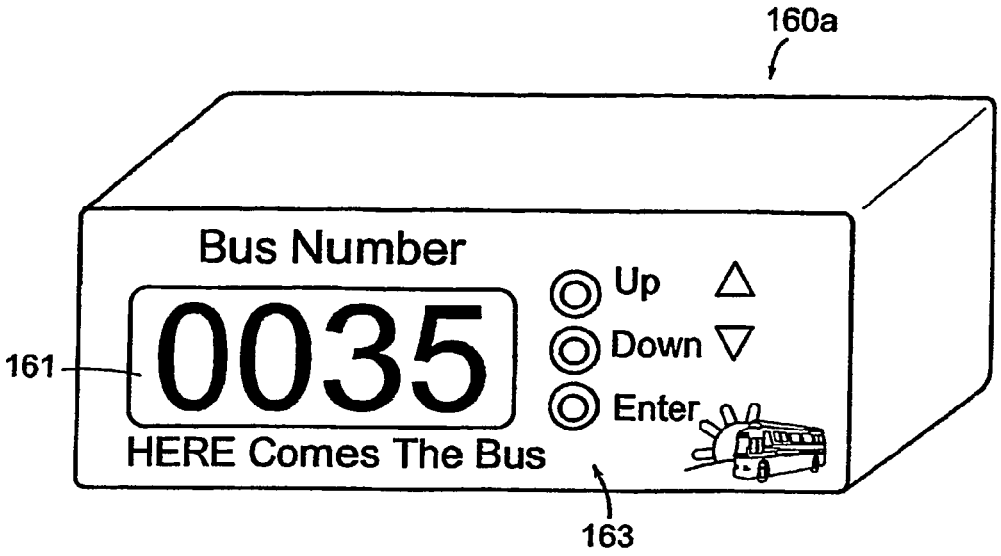
FIGS. 2A, B are perspective views of illustrative transmission apparatuses.
Figure 2B:
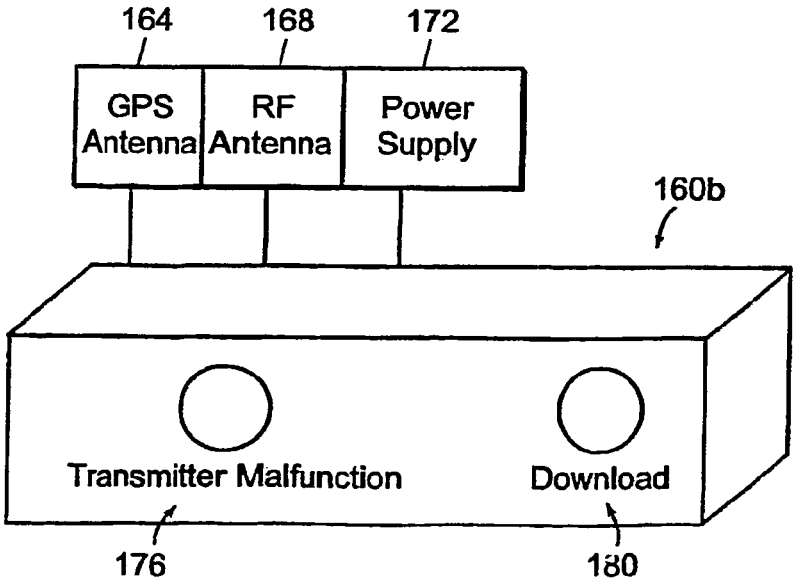
FIG. 2C is a block diagram of a transmission apparatus.
FIG. 2D is a block diagram of a transmission apparatus according to embodiments of the present invention.
Figure 2C:
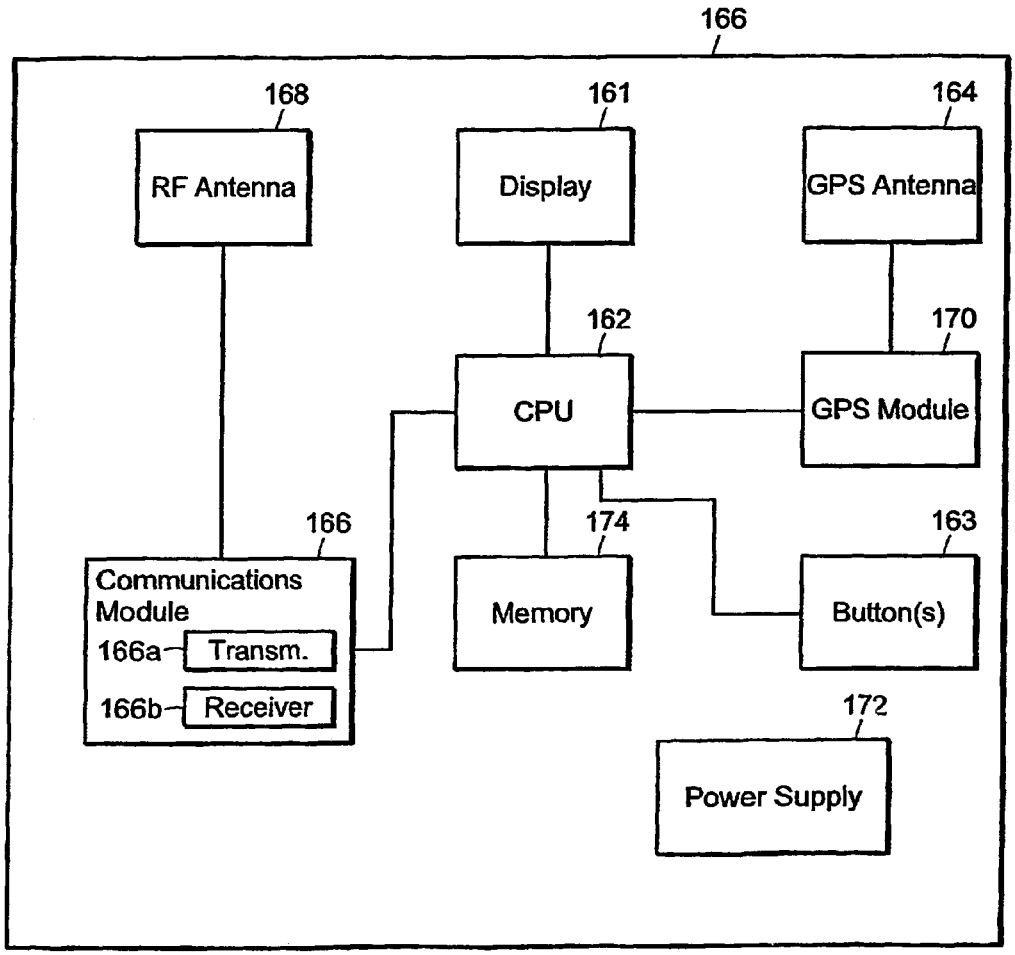

Referring now also to FIGS. 2A-C, there is shown perspective views of exemplary transmission apparatuses 160*a,b* and a block diagram of a transmission apparatus 160 according to the present invention. In the following, reference number 160 is used when making reference to a transmission apparatus in general and not to the specific illustrative embodiments shown in FIGS. 2A,B. The perspective views illustrate transmission apparatuses 160*a,b* having different features and arrangements, however, in either embodiment, the transmission apparatus is configured and arranged to determine the location of the vehicle at any time as it is traveling along a given travel route and for transmitting a signal, more particularly an RF signal, that provides vehicle identification and vehicle location information. More specifically, the transmission apparatus 160 transmits a signal in accordance with a predetermined frequency, cycle or period, where each signal provides such information.

As shown in FIG. 2C to perform the foregoing, the transmission apparatus 160 includes a microprocessor or central processing unit (CPU) 162, a memory 174, a GPS antenna 164, a GPS module 170, a communications module 166, an RF antenna 168, a display 161, buttons 163 and a power supply 172. The communications module 166 comprises any one of a number of devices or circuitry known to those skilled in the art for generating and transmitting an RF signal in a desired frequency band, including analog and digital signals. In an alternative embodiment, the devices or circuitry embody spread spectrum signal generation techniques. In more particular embodiments, the communications module 166 comprises a transmitter 166*a* and a receiver 166*b* so that the communications module is capable of both transmission and reception of RF signals. In an alternative embodiment, the communications module 166 includes a transceiver as is known to those skilled in the art. As hereinafter described, providing the capability of receiving RF signals allows the transmission apparatus 160 to check the transmission frequency band to determine if the channel is clear as well as allowing the transmission apparatus to be remotely updated wirelessly. In a specific embodiment, the communications module 166 is configured and arranged for broadcasting and/or receiving signals in the UHF business band, more specifically a frequency of about 463.7 MHz. Further, the UHF transmitter/transceiver comprising the communications module 166 has a power output of about 40-45 Watts.

The GPS module 170 is any one of a number of devices or circuitry known to those skilled in the art that receives signals from a plurality or more of global positioning satellites (not shown) of a global positioning system (GPS) via a GPS antenna 164. As is known to those skilled in the art, the GPS module 170 determines the location or position of the GPS module using the signals from these GPS satellites and thus, also thereby determines the location or position of the vehicle. This information about vehicle location is communicated from the GPS module 170 to the transmission apparatus CPU 162 for further processing.

The transmission apparatus CPU 162 comprises any of a number of microprocessors or CPU's known to those skilled in the art that are appropriate for the use and functions as described herein. An applications program also is included for execution in the CPU 162 which application program includes instructions and criteria to control the processes and functionalities of the transmission apparatus 160 including protocols; tasks and functions carried out by the transmission apparatus. More particularly, the application program includes instructions and criteria to receive vehicle location information from the GPS module 170, process such vehicle location information, and to cause the transmission apparatus to transmit one or more signals that include information such as vehicle identification and vehicle location information. As noted above, these one or more signals are generated in accordance with a predetermined frequency, cycle or period. The specifics of such instructions and criteria of the applications program is further discussed below in connection with FIGS. 5A-D.

In more particular embodiments, the transmission apparatus CPU 162, more specifically the applications program being executed in the transmission apparatus CPU 162, includes instructions and criteria for monitoring the status and operability of the communications module 166. If the transmission apparatus CPU 162 detects a failure or determines that the communications module 166 is not able to fully perform in the intended manner (e.g., transmit and/or receive RF signals), then the CPU outputs a signal activating a malfunction warning light 176 (FIG. 2B) and/or provides a warning message on a display 161.

The transmission apparatus 160 also includes a memory 174, preferably any one of a number of non-volatile type of memory known to those skilled in the art and which is appropriate for the intended use. The transmission apparatus memory 174 stores configuration information including, for example, information relating to the travel route of the transporting vehicle and in the case of a school bus, such information can include the school district and bus number. The transmission apparatus memory 174 is in addition to the random access memory (RAM) used in connection with the CPU, and such nonvolatile memory includes flash and spindle types of memory. In addition, the transmission apparatus memory 174 also can be used to store vehicle location information and a time sequence for later retrieval and use for the above described monitoring and analysis. The transmission apparatus memory 174 is sized so as to be capable of a storing the intended information.

As illustrated in FIG. 2A, the display 161 also can be used to display the vehicle identifier for the transporting vehicle in which the transmission apparatus is located, for example the bus number. In addition, the buttons 163 (e.g., the enter and up/down buttons) can be utilized in conjunction with the display 161 and the applications program to enter the configuration information in to the transmission apparatus memory 174, such as the bus number and school district. In a further embodiment, the transmission apparatus 160 is configured with a button or switch that once actuated sends out a signal requesting immediate assistance such as for example from the police because of an unruly passenger or a broken down vehicle (e.g., a disabled bus or ambulance).

The transmission apparatus 160 also includes a power supply 172. In a particular embodiment, the power supply 172 comprises the electrical power source of the transporting vehicle. More particularly, the transmission apparatus 160 is wired to the electrical power source of the transporting vehicle such that the transmission apparatus is continuously powered while the ignition switch is in the on or accessory position. The present invention, however, is not limited to this particular form of a power supply and other power supply's as is known to those skilled in the art, including batteries, are contemplated for use with the present invention.

Figure 2D:
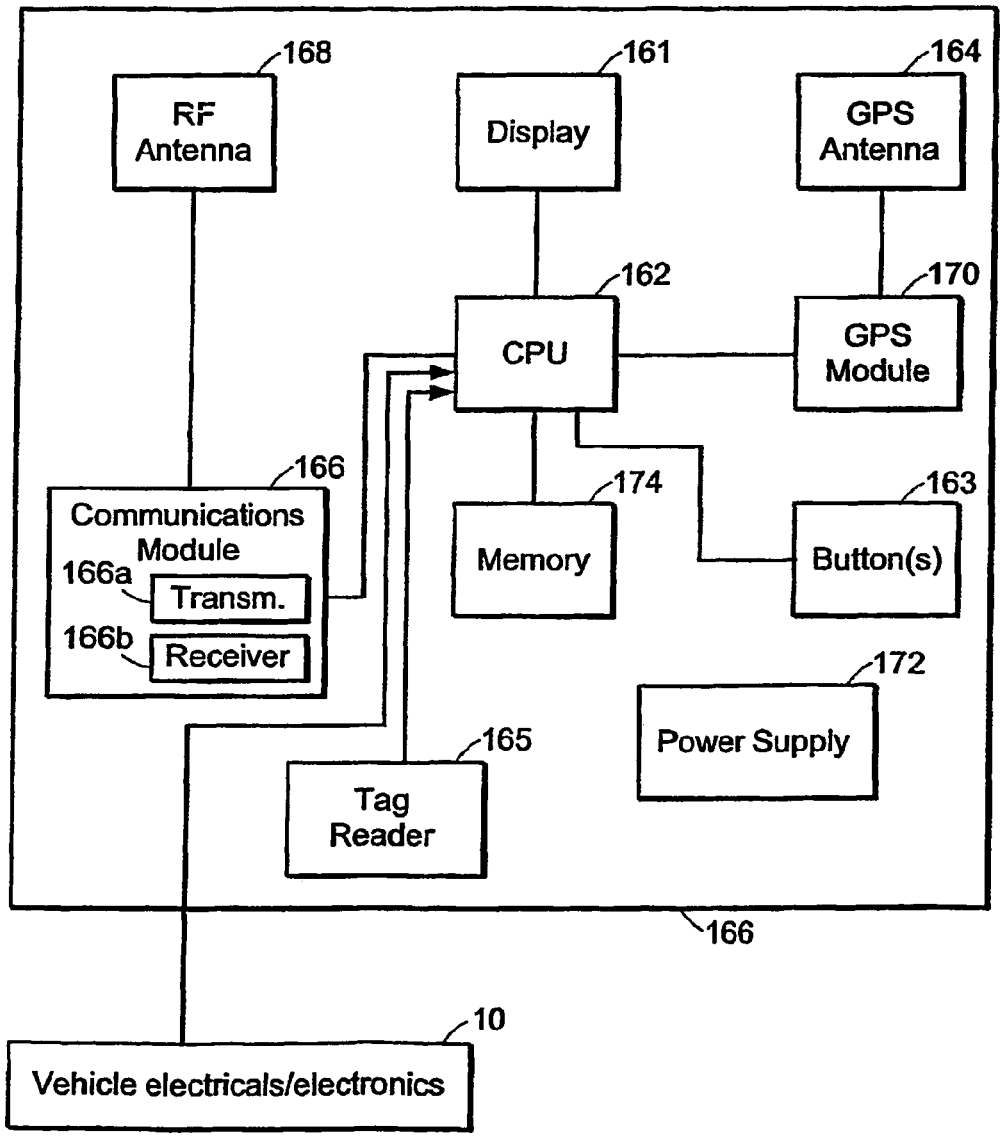

In further embodiments, and with reference to FIG. 2D, there is shown a block diagram of a transmission apparatus 160' that further includes a tag reader 165 and in which the CPU 162 is operably coupled to the electric circuitry and/or electronics 10 of the vehicle. According to an aspect of the present invention, the vehicle passengers are provided with a device or mechanism that can produce an RF, optical image or output signal that uniquely identifies each passenger as they board the vehicle such as a bus. One example of such device or mechanism is a passive RFID tag that provides an RF signal output when in the presence of an electrical field emitted by a RFID transceiving unit/card reader. Other examples of such a device or mechanism is a tag, label or other plastic or paper structure containing a bar code form of label that can be read by an optical scanning type of device. The tag reader 165 is any of a number of devices known to those skilled in the art that is appropriate for use with such a device or mechanism to obtain the RF or audio signal output and optical signal representative of the bar code label or other such optical coding format. For example, the tag reader 165 would be a transceiver that emits an electrical or magnetic field such that a passive tag identification is then received back, thereby identifying the person carrying the tag. The identification system could be RF based or one of a number of known optical scanning devices used in the art for scanning bar code labels and providing an output signal representative thereof.

As also shown in FIG. 2D, the CPU 162 is electrically and operably coupled to the electrical circuitry or electronics 10 of the vehicle so as to be capable of receiving signals, voltages of currents from such circuitry or electronics representative of a given condition and/or status of the vehicle. For example, a common practice with school buses is to cause safety lights to blink and/or cause other devices to be actuated when the bus is stopped to pickup students. Also, motor vehicles are typically provided with four-way or hazard light flashing circuitry that is selectively and manually activated by the driver to provide a visual signal indicating a vehicle that is not normally driving on a highway (e.g., a vehicle that has pulled over into the emergency lane on a highway). Additionally, the driver of the vehicle could carry an identification tag of their own or a smart card required to start the ignition for the purposes of driver identification. Such identification would provide for the ability to automate driver time cards and payment systems based on start and stop times. Thus, the CPU 162 is configured and arranged to monitor such vehicle conditions and/or signals to determine if they are representative of the particular condition that should be automatically reported back to a central dispatching location or the like via the transmission apparatus 160'. Such configuring and arranging includes providing appropriate interfacing circuitry between the electrical circuitry/electronics 10 of the vehicle and the CPU 162.

Figure 3A:
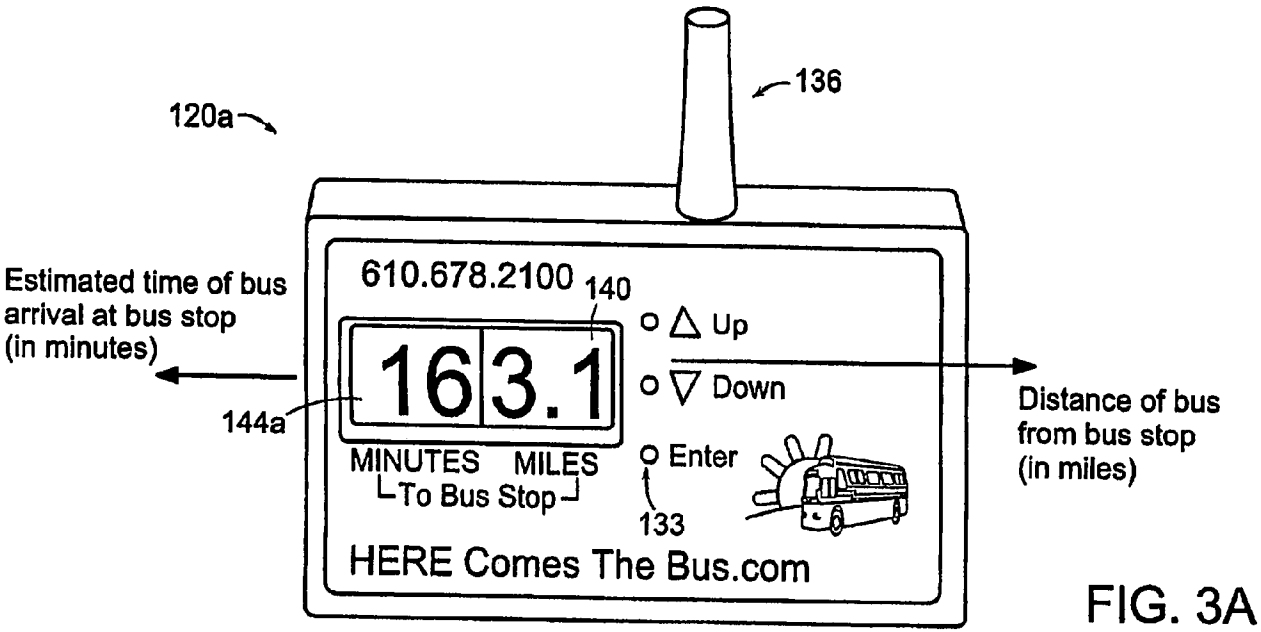
FIGS. 3A, B are perspective views of illustrative receiving units.
Figure 3B:
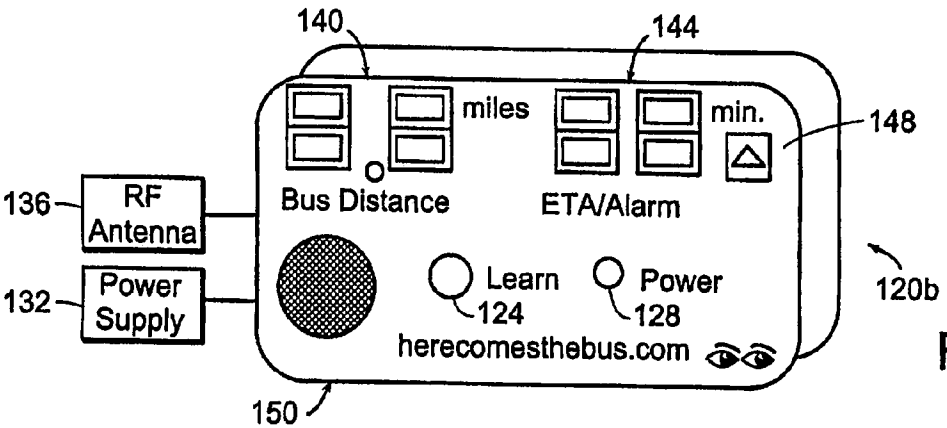
FIG. 3C is a block diagram of a remote receiving unit.
FIG. 3D is a block diagram of a destination/delivery site receiving system.
FIG. 3E is a block diagram of a receiving and monitoring system.
Figure 3C:
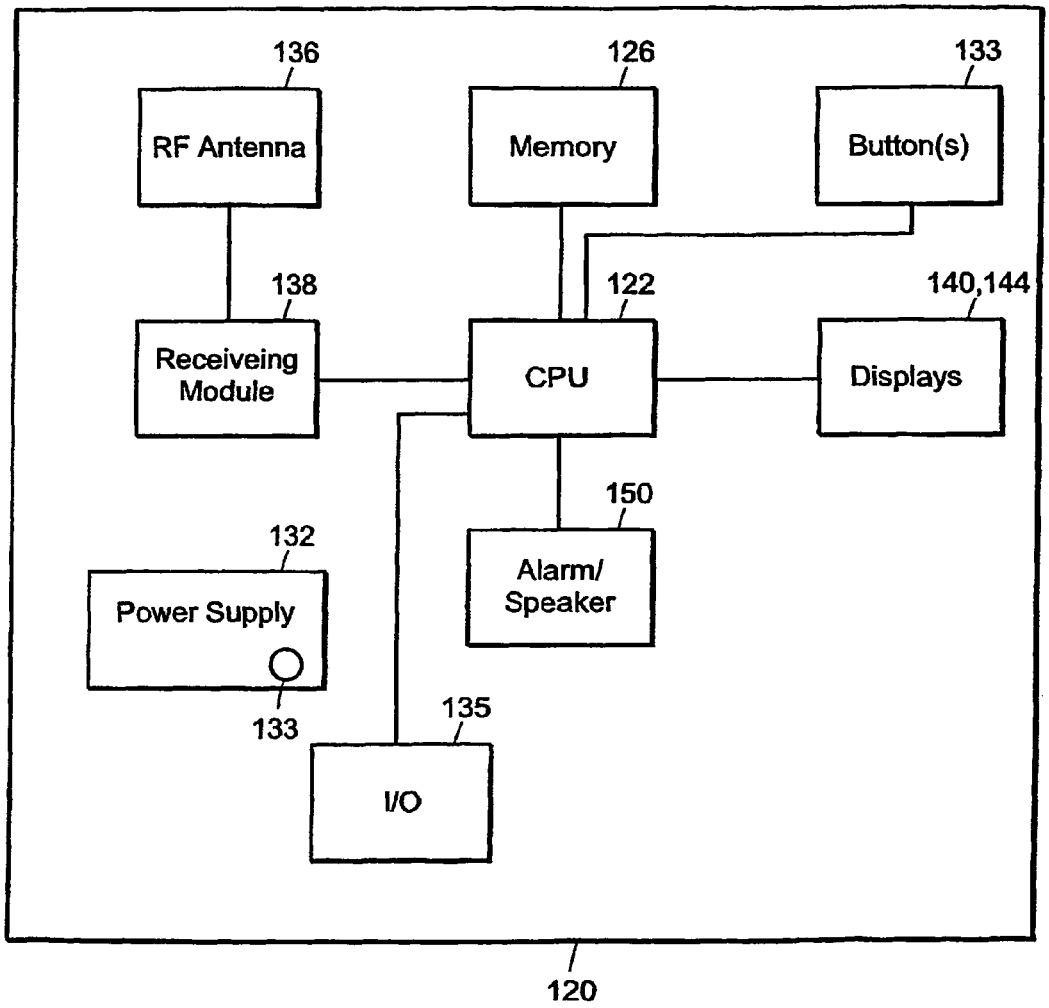

Referring now also to FIGS. 3A-C, there is shown perspective views of exemplary receiving units 120*a*, 120*b* and a block diagram of a receiving unit 120 according to the present invention. In the following discussion, reference number 120 used when making reference to a receiving unit in general and not to the specific illustrated embodiments shown in FIGS. 3A,B. The perspective views illustrate receiving units having different features and arrangements, however, in either embodiment the receiving unit 120*a,b* is configured and arranged to receive RF signals being transmitted by the transporting vehicle, processing the signals, determining the estimated time of arrival (ETA) of the transporting vehicle to a vehicle stop proximal to the receiving unit, determining the distance the transporting vehicle is from the vehicle stop, displaying the determined ETA and distance, and providing an alarm when one of the ETA or distance is less than a threshold value. The receiving unit 120 also is configured and arranged such that it can learn information needed to carry out the foregoing functions. The receiving units 120, as illustrated in FIG. 1, are located along a vehicle route to receive signals being broadcasted from at least one vehicle transmission apparatus 160 that is within broadcast range and alert passengers when the correct vehicle is closer than a specified threshold location or distance or less than a specified ETA. In a more particular application or use, the receiving unit 120 is used to determine, displaying and provide alarms for the arrival of the bus or other transportation vehicle that is picking up or dropping off school children.

As shown in FIG. 2C, the receiving unit 120 includes a microprocessor or central processing unit (CPU) 122, a memory 126, a receiving module 138, an RF antenna 136, an alarm/speaker 150, a display made up of a plurality of display portions 140,144, one display portion 144 to display the ETA and another display portion 144 to display the distance 140, an I/O port 135 and a power supply 132. These display portions may be positioned so as to be proximal each other as shown in FIG. 3A or separated from each other as is shown in FIG. 3B. The receiving unit 120 also includes one or more switches and/or buttons 133 (e.g., the enter and up/down buttons shown in FIG. 3A) that allow a user to select various programming functions including the learn function, index through a menu and perform other functionalities associative with the receiving unit operation as more fully described hereinafter.

The receiving unit receiving module 138 and RF antenna 136 comprise any one of the number of devices or circuitry known to those skilled in the act for receiving an RF signal in a desired frequency band, including analog and digital signals. In an alternative embodiment, the devices or circuitry embody spread spectrum signal generation techniques. In a specific embodiment, the receiving module 138 and RF antenna 136 are configured and arranged to receive signals in the UHF business band, more specifically a frequency of about 463.7 MHz. Although the RF antenna 136 is illustrated as being integral with the receiving unit 120*a* in FIG. 3A, it is within the scope of the present invention for the RF antenna to be located remote from the receiving unit and to be electrically interconnected to the receiving module 138 using any one of a number of techniques known to those skilled in the art (e.g., interconnected by cables) as is illustrated in FIGS. 1A,B. It also is within the scope of the present invention, for the receiving unit 120 to be configured and arranged with an internal antenna and to have a port or connection that would allow the receiving module 138 to be coupled to an external antenna.

The receiving unit CPU 122 comprises any of a number of microprocessors or CPU's known to those skilled in the art that are appropriate for the use and functions as described herein. An applications program is also included for execution in the CPU 122 which application program includes instructions and criteria to control the processes and functionalities of the receiving unit 120 including protocols, tasks and functions carried out by the receiving unit. More particularly, the application program includes instructions and criteria to receive vehicle location information from the transmission apparatus 160 of a given vehicle associated with the vehicle travel route and vehicle stop that is proximal the location of the receiving unit and to cause the appropriate information to be displayed and the appropriate alarms to be generated based on the information received from the transmission apparatus. The specifics of such instructions and criteria of the applications program is further discussed below in connection with FIGS. 5A-D.

In more particular embodiments, the receiving unit CPU 122, more specifically the applications program being executed in the receiving unit CPU 122, includes instructions and criteria for monitoring the status and operability of the receiving unit 120 more particularly the receiver module 138 thereof. If the receiving unit CPU 122 detects a failure or determines that the receiving unit 120 is not able to fully perform in the intended manner (e.g., receive RF signals), then the CPU outputs a signal activating a malfunction warning light and/or providing a message on a display.

The receiving unit 120 also includes a memory 126, preferably any one of a non-volatile type of memory known to those skilled in the art and which is appropriate for the intended use. The receiving unit memory 126 stores configuration information including, for example, information relating to the travel route of the transporting vehicle. In the case of a school bus, such information includes the school district and bus number. The receiving unit memory 126 is in addition to the random access memory (RAM) used in connection with the CPU, and such nonvolatile memory includes flash and spindle types of memory. In addition, the receiving unit memory 126 also is used to store vehicle location information in a time sequence for retrieval to determine ETAs and the distance between the vehicle and the vehicle stop at a given time. The receiving unit memory 126 also is sized so as to be capable of a storing the intended information. In more particular embodiments, and as further described herein, the receiving unit memory 126 further includes information relating to the timing protocol for the transmission apparatus 160, coded information so that the receiving unit can be accessed from a remote location to control the service is in regards to payment or non-payment for the service, storing threshold values for alarming and/or a historical log.

The displays comprising the vehicle display portions 140, 144 for distance and ETA are any of a number of displays known in the art that display alphanumeric information. In a particular embodiment, the displays are LCD type of displays, however, the present time invention is not particular limited to this type of display. The ETA display portion 144 is configured and arranged to display the estimated time of arrival of the transporting vehicle (e.g., bus) at the vehicle stop proximal the location of the receiving unit 120. The distance display is configured and arranged to display the distance of the transporting vehicle from the vehicle stop while the vehicle is in-transit. Typically, time is displayed in minutes and distance is displayed in miles. In addition to providing an auditory alarm 150, the receiving unit 120 can be configured and arranged so that these display portions 140, 144 are changed in appearance (e.g., the display blinks) to provide a visual indication of the alarm condition.

The receiving unit 120 also includes a power supply 132. In a preferred embodiment, the power supply 132 is configured and arranged so that the receiving unit 120 is portable. For example, the power supply 132 comprises one or more batteries. In addition, the receiving unit 120 can be configured and arranged to further include an electrical power port or connection 133 that can be electrically interconnected to a transformer connected to an electrical outlet located in the household, business or school so that the receiving unit can be continuously powered without the interruption associated with the replacement of batteries. The present invention, however, is not limited to this particular form of a power supply and other power supplies as is known to those skilled in the art are contemplated for use with the present invention.

As indicated in the discussion above regarding FIG. 1B, according to an aspect of the present invention the receiving units 120 are connected to a communications network so that information can be transmitted amongst the receiving units. More particularly, the receiving units 120 are coupled to the communications network via a communications link 180 (e.g., modem, cable modem, etc.). In an illustrative embodiment, the receiving unit 120 includes an I/O port or connection 135 which connection couples the receiving unit CPU 122 to the communications link 180 and thus to the communications network. In addition, the applications program being executed in the receiving unit CPU 122 also includes instructions and criteria for controlling the reception and transmission of messages to/from any given receiving unit 120. The I/O port or connection 135 is any of a number of ports/connections known to those skilled in the art including RS-232 and USB type of connections as well as emulating a wireless type of communication interface.

Figure 3D:
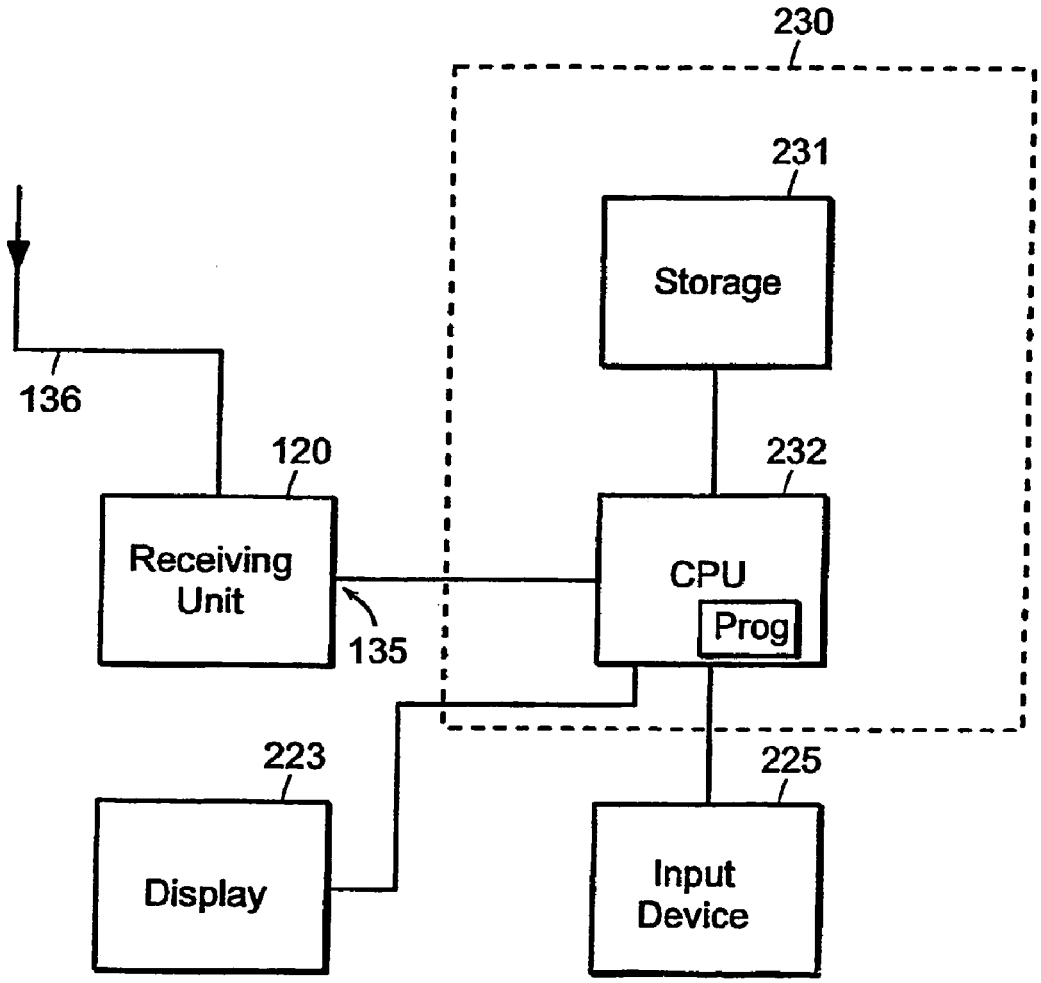

Referring now to FIG. 3D, there is shown a receiving system particularly configured for use at the destination/delivery site for the transporting vehicle, hereinafter destination/delivery site receiving system 220. The destination/delivery site receiving system 220 includes a personal computer 230, a receiving unit 120, an RF antenna 136, a display unit 223, and an input device 225. Reference shall be made to the foregoing discussion regarding FIG. 3C for details regarding receiving unit 120 and the RF antenna 136 not otherwise discussed hereinafter. In the illustrative embodiment, the RF antenna 136 is remote from the receiving unit 120 which is illustrated in FIG. 1B. As noted above, however, the antenna can be co-located in the housing with the other components of the receiving unit 120.

In the illustrated embodiment, the receiving unit 120 is configured to receive and to pass all of the received messages onto the personal computer 230 via the receiving unit I/O port 135. The use of a receiving unit 120 as a communication device shall not be construed as a limitation as it is with the scope of the present invention to configure and arrange the system 220 so as to have stand-alone communications that interface directly with the personal computer.

The personal computer includes a microprocessor or CPU 232 that comprises any of a number of microprocessors or CPU's known to those skilled in the art that are appropriate for the use and functions as described herein. An applications program is also included for execution in the CPU 232 which application program includes instructions and criteria to control the processes and functionalities of this receiving system 220 including protocols, tasks and functions carried out by the system. More particularly, the application program includes instructions and criteria to receive vehicle location information from the transmission apparatus 160 for any vehicle that will be arriving at the destination/delivery site, to cause the appropriate information to be displayed and to cause the appropriate alarms to be generated based on the information received from the transmission apparatus. When the destination/delivery site receiving system 220 is interconnected to a communications network for data/information sharing, the applications program further includes instructions and criteria for receiving data/information via the communications network and integrating such information/data with that being received directly from the transmission apparatus 160 as well as controlling the transmission of data information into the communications network. The specifics of such instructions and criteria of the applications program is further discussed below in connection with FIGS. 5A-E.

In more particular embodiments, the CPU 232, more specifically the applications program being executed in the CPU 232, includes instructions and criteria for monitoring the status and operability of the receiving unit 120. If the destination/delivery site receiving unit CPU 232 detects a failure or determines that the receiving unit is not able to fully perform in the intended manner (e.g., receive RF signals and/or passes them along), then the CPU outputs a signal activating a malfunction warning light and/or providing a message on a display.

An input device 225 is operably coupled to the CPU 232 so as to allow a user to select functions, types of displays to be shown, and to input configuration information such as the vehicle identification for vehicles arriving at the destination/delivery site. Such an input device 225 includes but is not limited to keyboards and/or mouses.

The display 223 is any of a number of display devices known to those skilled in the art including, but not limited to, CRT, LCD and plasma types of displays that are otherwise appropriate for the intended use. The display 223 is operably coupled to the CPU 232 such that vehicle identification, vehicle ETA and vehicle distance information is displayed and updated by the CPU as each location information packet/message is received from an in-transit transporting vehicle. In more specific embodiments, the display 223 is of the type that is capable of providing the mapping displays shown in FIGS. 7A,B.

The personal computer 230 also includes a storage device 231 to store configuration information including, for example, information relating to the travel route of each transporting vehicle that would be 'arriving at the' destination/delivery site for dropping off passengers or picking up passengers. In the case where a school is the destination/delivery site, such information includes the school district and bus number for each bus that would be arriving at the school to drop students off for school or at the end of a school day to pick-up students to bring them home.

In addition, the storage device 231 is used and sized to store vehicle location information for each vehicle arriving at the destination/delivery site in a time sequence for retrieval to determine ETAs and the distance between the vehicle and a given destination/delivery site at a given time. In more particular embodiments, and as further described herein, the storage device 231 further includes information relating to the timing protocol for the transmission apparatus 160, the location or positional information (e.g., GPS coordinates) for the destination/delivery site, storing threshold values for alarming and/or a historical log.

The storage device 231 is any of a number of devices or combination of devices known to those skilled in the art that is appropriate for the intended use including magnetic hard drives, nonvolatile memory (e.g., spindle or flash) or a combination thereof. The storage device 231 is in addition to the random access memory (RAM) used in connection with the CPU 232. In an exemplary embodiment, the storage device 231 includes a short-term storage such as nonvolatile memory, and long-term storage such as a magnetic hard drive, so that information and/or data being acquired on the fly is temporarily stored in the short-term storage and later transferred or written to the long-term storage by the CPU 232.

Figure 3E:
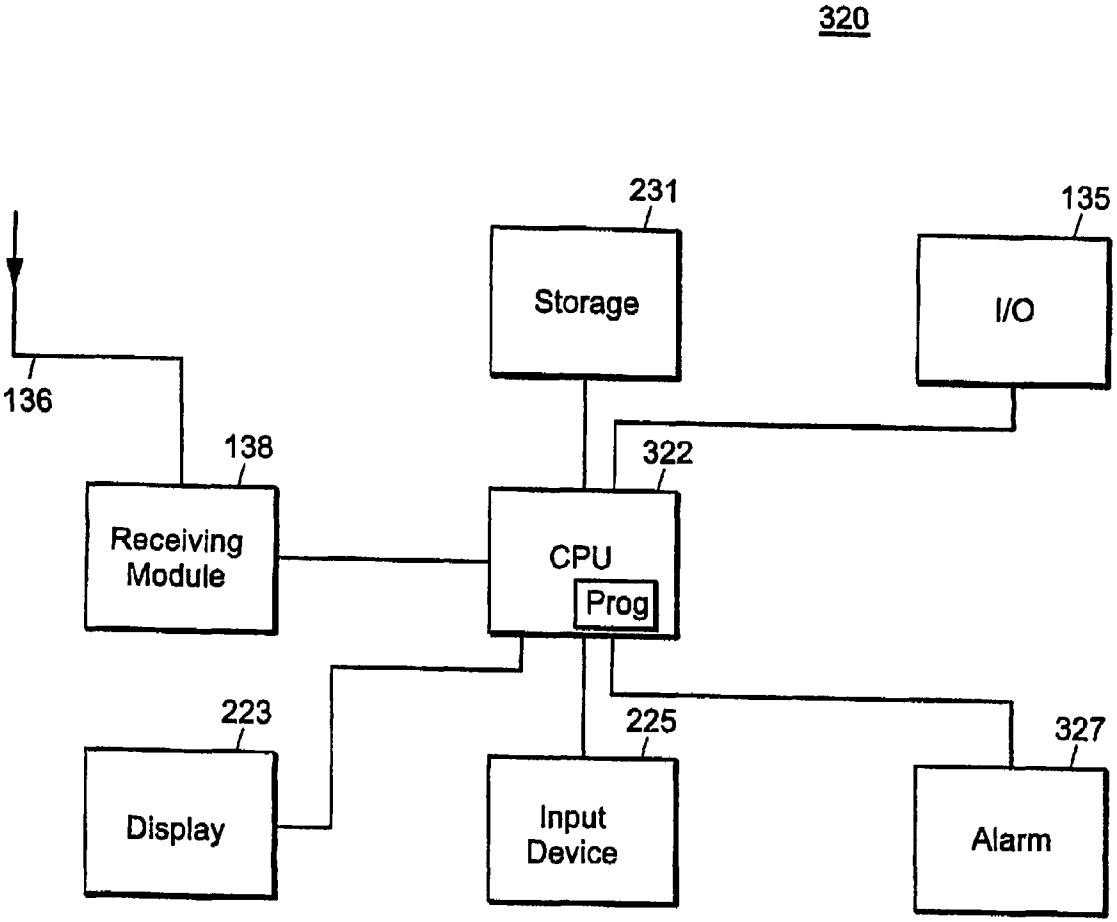

Referring now to FIG. 3E, there is shown a receiving and monitoring/tracking computer system 320 according to the present invention that is particularly configured for use at any of a number locations including a central dispatching location (see FIG. 1A) for all the vehicles that are in-transit in an area/region or any one or more of the destination/delivery sites (FIG. 1A) with a designated area/region. The receiving and monitoring/tracking computer system 320 includes a microprocessor or central processing unit (CPU) 322, a storage device 231, a receiving module 138, an RF antenna 136, a display unit 223, an I/O port 135, an input device 225 and an alarm 327. Reference shall be made to the foregoing discussion regarding FIGS. 3C-D for details regarding the receiving module 138, the RF antenna 136, the I/O port or connection 135, the storage device 231 the display unit and the input device not otherwise discussed hereinafter. In the illustrative embodiment, the RF antenna 136 is remote from the receiving module 138 which is illustrated in FIG. 1B. As noted above, however, the antenna can be co-located in the housing with the other components of the receiving unit. As to the storage device 231, this device is sized and configured so as to be capable of storing information being acquired by the receiving and monitoring unit 320 for monitoring and later use and off line analysis of data/information.

The receiving and monitoring system CPU 322 comprises any of a number of microprocessors or CPU's known to those skilled in the art that are appropriate for the use and functions as described herein. An applications program is also included for execution in the CPU 322 which application program includes instructions and criteria to control the processes and functionalities of this receiving system 320 including protocols, tasks and functions carried out by this receiving system. More particularly, the application program includes instructions and criteria to receive vehicle location information from the transmission apparatus 160 for any vehicle in-transit in a given area being covered by a given receiving and monitoring system; to cause the appropriate information to be displayed and to cause the appropriate alarms to be generated based on the information received from the transmission apparatus on each in-transit vehicle. Further, the application program includes instructions and criteria for real-time mapping of the travel route for one or more in-transit vehicles, displaying such real-time mapping, and/or providing alarms in cases where the real-time mapping indicates that the vehicle may be exhibiting mechanical problems or has substantially deviated from the designated travel route. When the receiving and monitoring system 320 is interconnected to a communications network for data/information sharing, as illustrated in FIG. 1B, the applications program further includes instructions and criteria for receiving data/information via the communications network and integrating such information/data with that being received directly from the transmission apparatus 160 as well as controlling the transmission of data/information into the communications network. The specifics of such instructions and criteria of the applications program is further discussed below in connection with FIGS. 5A-F.

In more particular embodiments, the receiving and monitoring system CPU 322, more specifically the applications program being executed in the receiving system CPU 322, includes instructions and criteria for monitoring the status and operability of the receiving and monitoring unit receiver module 138. If the receiving and monitoring system CPU 322 detects a failure or determines that the receiver module 138 is not able to fully perform in the intended manner (e.g., receive RF signals), then the CPU outputs a signal activating a malfunction warning light and/or providing a message on a display. The alarm 327 is any of a number of visual and/or auditory alarms known to those skilled in the art that are appropriate for the intended use.

In addition to real-time monitoring, the receiving and monitoring system 320 can be used to analyze off-line the location and time information that has been acquired and stored in the storage device 231. Such analysis can be used to evaluate driver performance as well as optimizing and selecting travel routes as well as modifying travel routes to account for changes in road conditions, such as for example road construction. As such, the application program being executed the receiving and monitoring system CPU 322 includes instructions and criteria for performing such analysis.

The use, operation and function of a vehicle notification and/or vehicle location systems according to the present invention can be best understood from the following discussion and with reference to FIGS. 1 and 4-7. Reference also should be made to FIGS. 2 and 3 for features and details of the transmission apparatus 160, the receiving unit 120, the destination/delivery site receiving system 220 and the receiving and monitoring system 320 not otherwise shown or described in FIGS. 4-7. Although the following describes a combined vehicle notification and vehicle location system, this shall not be construed as a limitation as it is within the scope of the present invention for a system to be configured and arranged for vehicle notification or for vehicle location/mapping. Also, although the following describes the system in terms of a bus/school system, this also shall not be construed as a limitation as it is within the scope of the present invention for the system(s) to be used in conjunction with any of a number of vehicles. It also should be recognized that the following also describes the instruction and criteria of the applications programs that are executed on the transmission apparatus CPU 170, the receiving unit CPU 122, the destination/delivery site personal computer 230 and the receiving and monitoring unit CPU 322 to carry out the below described methodology.

Figure 5A:
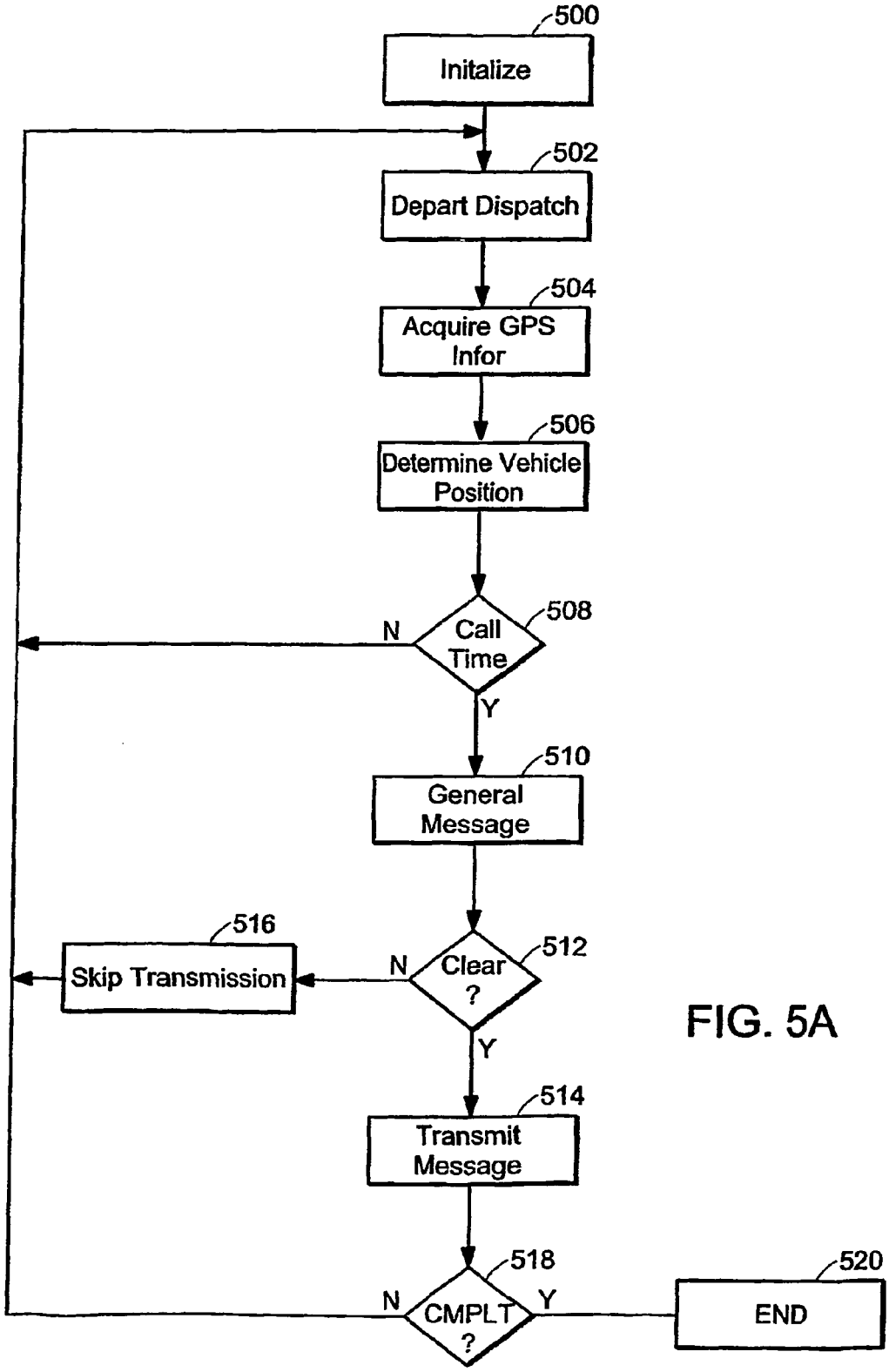
FIG. 5A is a flow diagram illustrating an exemplary process for transmitting information to the receiving unit according to the present invention.

There is shown in FIG. 5A, a flow diagram that illustrates an exemplary process for transmitting information from the transmission apparatus 160 in a vehicle to the receiving unit 120 located in a household, business, school or other appropriate location. Before transmitting information, the transmission apparatus 160 is initialized, step 500. The transmission apparatus 160 is initialized so the appropriate information is provided and stored in the memory 174 for later use in determining vehicle position/location and/or for transmitting information. Such initialization can be accomplished using any of a number of techniques known to those skilled in the art, including but not limited to, manually, wireless transmission, a transmission pendant that is selectively, electrically connected to the transmission apparatus, smart cards, or electrically connecting a personal computer to the transmission apparatus. For example, the transmission apparatus 160 could include instructions to automatically contact the dispatch base station to automatically start synchronization/initialization after certain conditions are met (e.g., vehicle is started and put into gear).

As part of this initialization, the transmission apparatus memory 174 is provided information that identifies the vehicle which is traveling along a given travel route at a given time. In the case of a school bus, such information would be the school district and bus number. Also, other information such as whether the bus is the AM pick-up or the PM drop-off, whether that day is the last day of the school week, or that the receiver time needs to be adjusted for daylight savings is inputted into the transmission apparatus memory 174. Such other information would be transmitted along with any positional information so as to update the receiving unit 120, destination/delivery site receiving system 220 or the receiving and monitoring system 320 so that these units/systems can modify their operations. In this way, each of these receiving units/systems knows which bus it should be looking for (e.g., the morning or afternoon bus) or whether the bus will be arriving one hour earlier on later than is presently programmed because of a daylight savings time change. In the case of the remotely located receiver units 120 in proximity to vehicle stops, the receiving unit also knows whether a weekend is coming so the receiver can shut down and conserve power when such receiving units include power supplies having limited and predetermined capacities (e.g., battery power supplies).

According to the present invention, vehicle transmissions are controlled so that they occur at predetermined times and also in accordance with a pre-established protocol or timing plan. Thus, and as part of initialization, the transmission apparatus memory 174 is provided the periodic time interval for transmission of the vehicle position information (e.g., 10-30 second time interval). In more particular embodiments, the transmission apparatus memory is provided with a particular time slot having a predetermined duration that repeats every 10-30 seconds, more specifically repeats every 10 seconds. In addition, the transmission apparatus memory 174 also is provided with the information needed to implement any additional pre-established protocol or timing plan which further defines specific transmission times within the periodic time interval.

In further embodiments, the transmission apparatus 160 for each vehicle also sets its internal clock or time to correspond to GPS time. In this way, the clocks of each transmission apparatus 160 that are in motion and transmitting signals containing vehicle location information are synchronized with each other. Consequently, the potential for signal or message collisions being transmitted from different vehicles is essentially eliminated while providing or maintaining the capability for making large numbers of signal transmissions within a relatively short time period. In yet further embodiments, the CPU 162 periodically adjusts the time clock for a transmission apparatus based on GPS time to maintain synchronization among all mobile/in-transit units.

In a particular embodiment, a pre-established protocol or timing plan, hereinafter referred to as time slotting, is established to define specific time slots, where each time slot is allocated for the transmission of information from a given vehicle. Time slotting offers a number of advantageous benefits particularly when the application involves school buses. For example the same time intervals for non-adjacent school districts can be reused much like in a cellular network. For example, school district 3, 8 and 13 would be nonadjacent school districts and thus, buses could transmit during the same time interval (e.g., interval 3). It is within the scope of the present invention, particularly for systems that embody vehicle tracking capabilities, for time slots throughout all of the school districts of a given city or town to be defined and established so that time slots are uniquely assigned throughout so that two buses or vehicles do not interfere, collide or transmit a signal at the same time.

In illustrative exemplary embodiments, a time slot with duration of 10-20 milliseconds is allocated for transmission of vehicle location/identification information for each vehicle comprising all of the vehicles that can be in transit at any given time. For example, a time slot is assigned to each vehicle number. Also, such a time slot is periodically repeated every 10 to 30 seconds for each vehicle. In this way, for example, for a 20 millisecond time slot, 500 vehicles can transmit signals within a 10 second interval or 1500 vehicles can transmit signals within a 30 second interval without the potential for signal collision.

Also, time slotting provides a mechanism that can be used for power management of the receiving unit 120. To conserve power, the receiving module 138 can be powered up only at those times when a transmission would be sent off by the transmission apparatus 160. Using the time slotting protocol a receiving unit 120 that has been properly initialized can establish a time reference for controlling the operation of the receiving module 138 for any transmission received from any bus. In addition to conserving power, the time slotting methodology minimizes the potential for signal collision or interference at the receiving unit level.

The time slotting embodiment is best understood with reference to the following exemplary discussion. Assume that a bus location transmission is to be made every 10 seconds and that each 10-second time period is broken up into a certain number of time intervals, for example five equally spaced time intervals of two seconds each and that each of these 5 intervals is further subdivided into 200 time slots. This would provide 1000 time slots for each 10-second time period (i.e., 5 intervals*200 time slots), where each time slot would be about 0.01 sec. in duration (i.e., time slot duration-TSD).

In one specific embodiment, to implement this technique the transmission apparatus memory 174 for each bus is updated as part of the initialization process to include the school district number (SDN) and the bus number (BN). Using this information the transmission apparatus CPU 162 calculates its time slot.

First a determined time interval (DTI) is calculated from the following relationship.

DTI=remainder [SDN/total number of intervals w/in transmission cycle]

Using the above information, the DTI would be 3 (i.e., remainder [13/5]=3).

Next the time for transmission (TFT) is calculated or determined from the following relationship.

TFT=(DTI*TNTS+BN)*TSD

Using the above information, TFT=(3*200+43)*0.01=6.4300 seconds (TNTS is the total number of time slots per time interval). Thus, a transmission should be made by bus number 43 in school district 13 had 6.4300 seconds during each 10 second time period. Preferably, such calculation of the time for transmission is performed as a part of the process for initializing the transmission apparatus.

As noted above, the location of the transporting vehicle/bus is determined using GPS satellites and the location of the transporting vehicle is defined in terms of longitude and latitude. In order to achieve location accuracy of 20 feet or less, the transmission message packet would have to allocate approximately 64 bits for longitude and latitude. Thus, and according to another aspect of the present invention, a grid coordinate system is established to define the location of the transporting vehicles. According to this aspect of the present invention, the transmission apparatus receives its coordinates in terms of GPS determined degrees of latitude in longitude and converts these GPS coordinates to grid coordinates based on the central location reference before transmitting such information to the receiving units. In this grid coordinate system, central grid coordinates are established in the center of the geographical region in which the transporting vehicles (e.g., buses) will be operating. In an exemplary embodiment, the central grid coordinates are at the location of the centralized bus depot.

Assume for purposes of discussion that the grid is 15 by 15 miles and there are 4,096 increments in each direction so there is about 19.3 feet per increment. With such a great coordinate system, the GPS degrees are converted to grid accordance using the following relationships.

Grid latitude=2048+round*[69*4096*(center lat−bus Lat)/15]

Grid longitude=2048+round*[53*4096*(bus long−center long)/15]*rounded to an integer After initialization is completed, the transporting vehicle (e.g., bus) departs the dispatching location step 502. Thereafter, the transmission apparatus GPS module 170 obtains GPS location information from the GPS system, step 504. Using this GPS longitude and latitude information, the transmission apparatus CPU 162, determines the position of the vehicle in the form that it should be transmitted in. In one embodiment, the GPS location (e.g., degrees longitude and latitude) is the proper form. In another embodiment, and as described above, a grid coordinate system is used to define a location of the transporting vehicle. Thus, and as more particularly described above, the transmission apparatus CPU 170 using the grid coordinate system information in the transmission apparatus memory 174 during initialization, converts the GPS longitude and latitudes into the grid coordinate longitude and latitude using the conversion formulas. In an exemplary embodiment, said acquiring (step 504) and determining (step 506) are sequenced so as to be performed closer to the scheduled time for transmission.

The transmission apparatus CPU 162 also determines if it is time to make a transmission of the message packet, step 508. In other words, the CPU 162 determines if the criterion established for when a given transporting vehicle should transmit a message has been satisfied. For the time slotting embodiment described above, and using the information provided in the transmission apparatus memory 174, the CPU 162 determines if the time corresponds to the time for the time slot assigned to a given vehicle. If it is not the right time (NO, step 508), then the process continues. As also indicated above, in further embodiments, the time or clock of the transmission apparatus 160 for at least each vehicle in transit is synchronized using GPS time obtained from the GPS signals.

If it is the right time (YES, step 508) then the transmission apparatus CPU 162 generates the message packet to be transmitted, step 510. In an exemplary embodiment, the transmission message packet includes a preamble, the school district number, the bus number, latitude, longitude, time of day information (AM/PM), day of week information (weekend coming), daylight savings information, and error detection information (e.g., CRC, check sum, etc.). The latitude and longitude information provided is that appropriate for the locational method being implemented (i.e., degrees or grid coordinates). The foregoing is illustrative of an exemplary message packet and thus, the message been transmitted shall not be particularly limited to this illustrative example.

In a particular embodiment, the protocol before transmitting a message also includes checking the communications channel or pre-designated RF frequency for signal transmission to determine if that channel/frequency is clear, step 512. More particularly, the transceiver or receiver 166*b* of the communications module 166 is used to monitor this channel or frequency to determine if there is another signal been transmitted at the time the message packet is to be transmitted. If the channel is determined to be clear (YES, step 512) then the transmission apparatus 160 transmits the message, step 514.

If it is determined that the channel/frequency is not clear (NO, step 512), then the message packet is not transmitted by the transmission apparatus 160 and the transmission apparatus CPU 162 skips the present transmission cycle, step 516. Thereafter, the process continues with the generation of the next signal/message packet at the appropriate time to call, in particular performing steps 504-512. Given that the time clocks for each transmission apparatus is preferably synchronized using GPS time, which is accurate on the order of nanoseconds, the potential for same time transmissions that could occur because of drifting clocks is essentially avoided.

In a particular illustrative embodiment, the transmission apparatus 160 is continuously powered and thus generates signals/messages packets as long as the transporting vehicle is in operation. As such, if the transporting vehicle is in operation (YES, step 518) and after the signal/message packet of the present transmission signal has been sent (step 514), then the process continues with the generation of the next signal/message packet at the appropriate time to call, in particular performing steps 504-512. If the transporting vehicle is no longer in operation, such as when the ignition is turned off, and thus has completed its operational cycle (YES, step 518), then the process is ended, step 520 and no further signals/message packets representative of the location of the transporting vehicle are transmitted.

In an alternative embodiment, the transmission apparatus CPU 162 makes an evaluation to determine if the transporting vehicle has completed the travel route, or the designated task as a means for determining if the operational cycle is completed, step 518. In other words, the CPU 162 makes a determination to see if the transporting vehicle has completed its task (e.g., arriving at the destination/delivery site) or whether it is still in transit along the travel route. If the vehicle is still in transit then the transmission apparatus CPU 162 determines that the operational cycle is not complete (NO, step 518) and the process described in steps 504-512 is repeated. If the vehicle is no longer in transit and thus has completed the travel route such as for example when the vehicle has arrived at the designated delivery site then the transmission apparatus CPU determines that the operational cycle is complete (YES, step 518) and the transmission process is ended, step 520. Thereafter, the transmission apparatus 160 of the transporting vehicle could be reinitialized so that it could perform another task, for example travel along a different travel route to pick-up a different group of passengers.

Figure 5B:
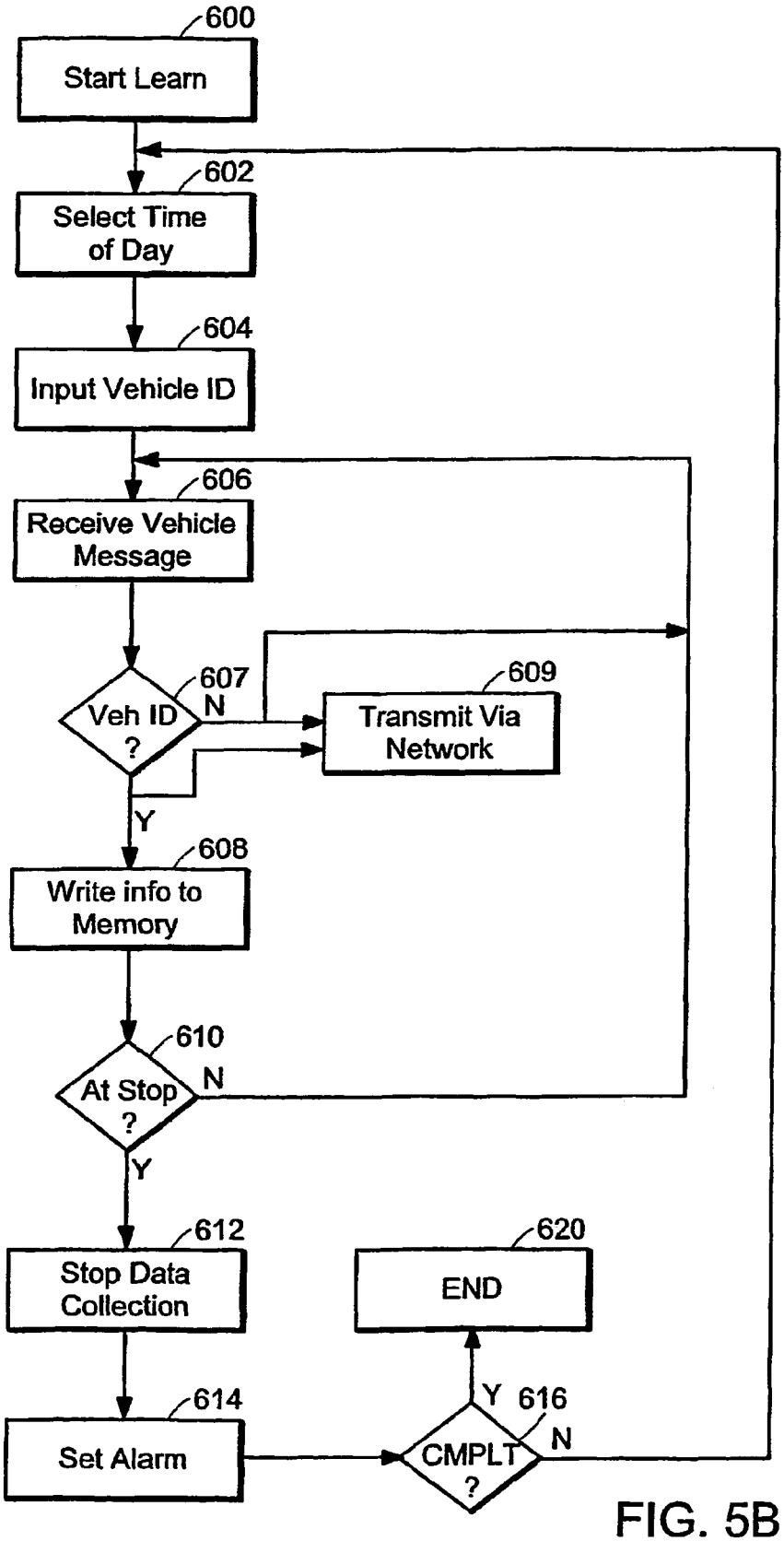
FIG. 5B is a flow diagram illustrating a process for initializing the receiving unit according to the present invention.

As indicated above, one or more receiving units 120 are located proximal each vehicle stop and these one or more receiving units are each configured and arranged to receive transmissions from the in-transit transport vehicle and to process the information contained in these transmissions so as to provide indications on estimated time of arrival in distance from the vehicle stop. These receiving units 120 are typically remote from the destination/delivery site, the central dispatch for the vehicles and/or the yard or location the vehicles are dispatched from. Before a receiving unit 120 can function as a receiving unit in the notification/vehicle location system, the receiving unit must be configured and arranged so that it can identify the transporting vehicle that is traveling along the travel route and also know the location of its vehicle stop (i.e., the stop that is proximal to the receiving unit). There is shown in FIG. 5B, a flow diagram illustrating the process for initializing the receiving units 120 according to the present invention so that the receiving unit can learn the information needed to function properly within the notification/vehicle location system. Although the following describes the learning process with reference to a bus, it should be recognized that the following procedure is adaptable so as to learn information for any type of transporting vehicle.

To begin this learning procedure, the user activates the learning program functions of the receiving unit, step 600. Typically, the user activates the learning program functions a predetermined time in advance of the expected time of arrival of the bus and the bus stop. In an exemplary embodiment, the user actuates a button or switch so as to activate a program menu and scrolls through the menu using the appropriate button(s) 133 on the receiving unit to locate the learning mode function. The user selects this learning mode and continues with the learning process.

After starting the learning function, the user selects the particular time of day for the bus that is to be later identified during this process, step 602. In other words, the user indicates whether this is the AM bus or the PM bus to distinguish between the bus that is used for picking up and the one for dropping off. The user also inputs the school bus number or the vehicle identification, step 604. From this information, the receiving unit 120 can determine if a signal that it is receiving, is for the particular bus involved with the learning process and later if the signal that is been received is for the particular bus the person is awaiting.

Basically, the receiving unit 120 listens for messages from the particular bus and once such messages are being received, the receiving unit and the learning process proceeds to the data/information acquisition stage of the learning process. Specifically, the receiving unit 120 receives each message, step 606 and evaluates the received message to determine if it is a message from the bus involved with the learning process. If it is such a message, the receiving unit CPU 122 processes the received message and writes information to the learn table, step 608. Consequently, the learn table contains the times (i.e., the time the message was heard) and the location coordinates of the bus. Typically system reception has a range of approximately 5-7 miles, though terrain and other variables affecting RF transmissions. It should be recognized that this is the range in the case where there is direct transmission to the receiving unit 120 from a given transmission apparatus.

In the case where the receiving unit 120 is connected to a communications network such as that shown in FIG. 1B so as to form a network of receiving units (e.g., a wide area network), the reception range of any given receiving unit can be in effect extended or increased when such signals are received by other receiving units of the network which are in turn communicated to other receiving units of the network via a communications link 180. In addition, in such a case each receiving unit of the network transmits the received message into the communication network so that is available to all of the receiving units connected to the communication network, step 609 (YES or NO, step 607). In an alternative embodiment, the receiving unit 120 determines the device or apparatus where the received message should be transmitted to as well as the network address for such device or apparatus and then transmits the received message to the network address for such device or apparatus.

When the message is received by the device or apparatus that should process the message as herein described, that device or apparatus when it receives such message as part of the message evaluation process also checks to see if the message transmitted by the network was already received by such device or apparatus, such as by means of the RF receiver connected thereto. In such case, such device or apparatus does not process the duplicative or repetitive message(s) further. If it is determined that the message communicated via the network is not duplicative or repetitive, then such device or apparatus processes the message as if it were received via the RF receiver.

In further embodiments, the CPU of each receiving unit of the network initially and periodically communicates over the network to determine a synchronization time and to adjust the time or clock for the receiving unit so as to thereby synchronize the time or clocks of all of the receiving units of the network. In an illustrative example, each CPU connects via the communications network to a website of the world-wide web which website provides a time signal such as that provided for example by an atomic clock. In this way, the timing of messages being received and transmitted via the network can be used to determine if the received message is a duplicative or repetitive message.

The date or acquisition process of steps 606-608 continues until the bus arrives at the bus stop, step 610. After the bus has arrived at the bus stop (YES, step 610) the data collection process is stop, step 612. In an exemplary embodiment, the user actuates a key or switch to indicate that the bus has arrived at the bus stop. After it is indicated that the bus has arrived at the bus stop, the receiving unit CPU 122 back calculates to determine how long the bus took to arrive at the bus stop from a particular bus message entry in the learn data table. This is simply done by subtracting the time for a particular bus message entry from the time when the bus arrived at the bus stop. By doing this, an associative ETA time can then be stored in the data table for each bus message entry row.

Figure 4:
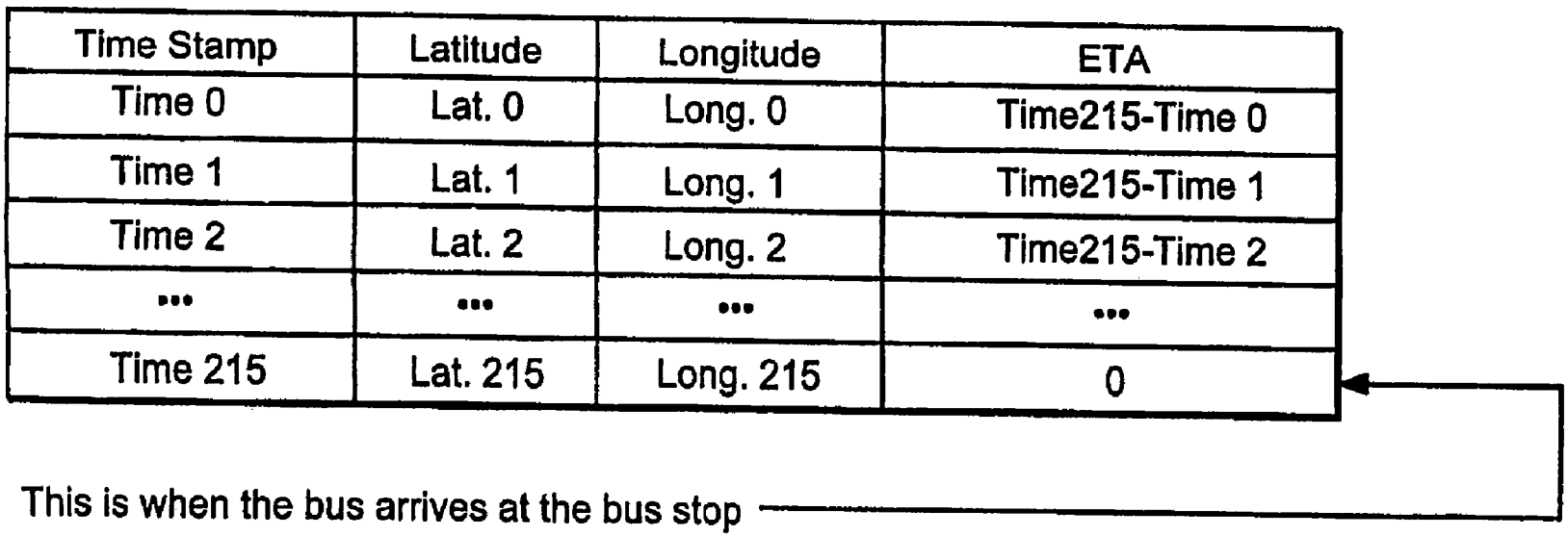
FIG. 4 is an exemplary learn table stored in a receiving unit illustrating the process by which the receiving unit learns the vehicle, the vehicle stop and estimated time of arrivals.

The data table completion process is best understood in the following example and also with reference to the abbreviated data table shown in FIG. 4. For this example, let's assume that the bus was six miles from the bus stop when the first message was received from the bus. Because the bus automatically transmits location messages every 10 seconds, a new row entry in the data table is created every 10 seconds. Let's also assume that the bus travels an average speed of 10 mph to get to the bus stop, so it will take the bus about thirty-six minutes to arrive at the bus stop from the transmission of the first message. As a result, there will be 216 rows in the data table, as is shown in the abbreviated data table illustrated in FIG. 4.

Following data acquisition and the generation of the learn data table, the user can set alarms, step 614. An alarm should be set for the estimated number of minutes the user wishes to be notified prior to the bus arrival. This information is typically stored in the receiving unit memory 126 and is accessed later by the receiving unit CPU 122 in the process of evaluating whether to actuate the alarm. In an exemplary embodiment, the receiving unit 120 is configured and arranged so that deal on that the alarm sounds for predetermined period of time (e.g. one minute) and then is shutoff.

After performing steps 602-614, the user determines if the learning process for all buses has been completed, step 616. If not (NO, step 616) the foregoing learning process is repeated for the next bus until the learning process is done for each bus the user wishes to track (YES, step 616), whereupon the learning process is ended, step 620. Consequently, there should be a learn data table stored in the receiving unit memory 126 for each bus. Because the bus approaches are likely to be different, it is likely that the learn tables for each bus also will be different.

The above-described learning process allows the manufacturer to avoid factory setups or reprogramming associated with bus route logistics. By allowing the user to have the receiving unit 120 learn its bus, the manufacturer does not have to be involved with bus routes changes, children changing busses or households moving within the same town. The learn function also provides a mechanism to generate the data necessary for developing and providing ETA's for a bus as it approaches the bus stop.

Figure 5C:
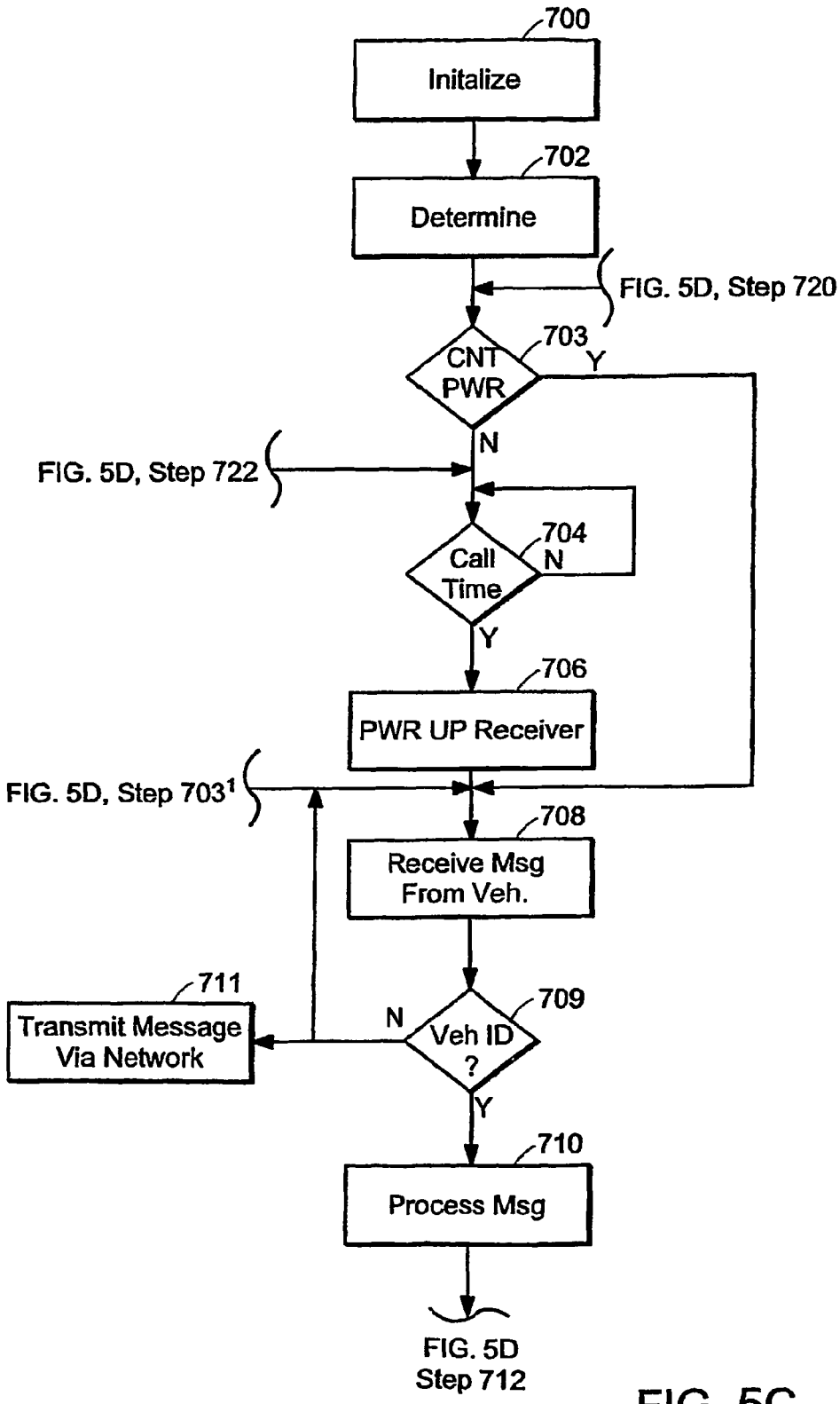
FIGS. 5C-D is a flow diagram illustrating a process for determining estimated time of arrivals at any given stop along a vehicle travel route according to the present invention.
Figure 5D:
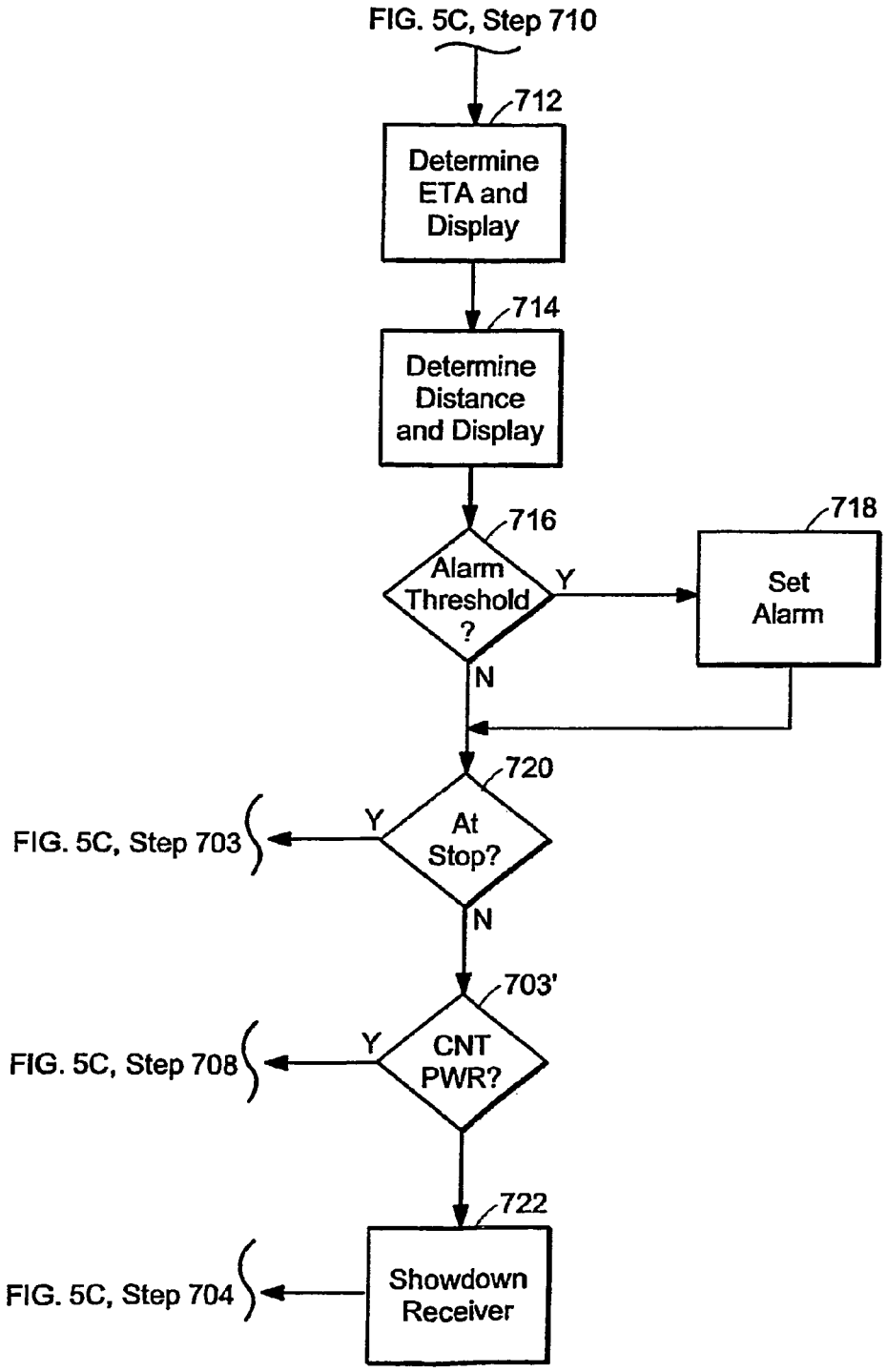

Now referring to FIGS. 5C-D there is shown a flow diagram of the process employed by the receiving unit 120 in determining estimated time of arrivals for each given vehicle along a travel route. Although the following describes the process using the transmission time slotting technique described above, it should be recognized that the following process is adaptable for use with other forms for controlling the timing of signal transmission and/or reception.

Before the receiving unit 220 is used in a particular application, the receiving unit is initialized, step 700. Such initialization mainly comprises performing the learning operation described in connection with FIG. 5B as hereinabove described. In addition, the receiving unit 120 is configured and arranged so as to determine the time slot that has been assigned to each of the transporting vehicles, step 702. Reference also should be made to the foregoing discussion, regarding the technique for determining a time slot and communication of same to the receiving unit.

After said initialization and determining is performed, a determination is made as to how the receiving unit is being powered, step 703. If the receiving unit 120 is connected to a power source that can supply energy continuously such that the receiver module 138 is continuously powered, (YES, step 703) then steps 704 and 706 are skipped and the process proceeds directly to step 708. If the power source has limited resources (e.g., batteries) and power management techniques are employed (NO, step 703) then the receiving unit 120 and more specifically the receiving unit CPU 122 continuously checks to see if it is time for the transmission apparatus 160 to transmit a transmission message packet, step 704. If it is time for a signal to be transmitted (YES, step 704), then the receiving unit receiver module 138 is powered up so that it can receive the transmitted signal at the appropriate time, step 706. If it is not time for a signal to be transmitted (NO, step 704), the receiving unit receiver module 138 remains powered down and the receiving unit 120 continues the checking process to see if it is time for a signal to be sent.

As noted above, the receiving unit 120 is configured and arranged so that it is mobile and is flexible for placement, in particular so the user can take the receiving unit with them to the bus stop while performing the learning process. Because the receiving unit is principally powered by batteries providing such mobility and flexibility, a power management routine to minimize the amount of time the receiver is powered up except at those appropriate times when a message is expected to be received from the vehicle or bus. In this way, power consumption is minimize and battery life extended. For example, since the bus message is 0.025 sec. or less, and buses only transmit once about every 10 seconds, the receiving unit receiver module 138 need only be on about 0.25 percent of the time. In practice, the on time can be further reduced by keeping the receiver module 138 turned off during evenings and weekends or at other times where messages are not to be transmitted.

After powering up the receiving unit receiving module 138, step 706, the message packet from the transporting vehicle is received by the receiving unit 420 and the receiving unit CPU 122 evaluates the received message to determine if it is a message from the bus that the receiving unit expects to receive a message from, step 607. If it is that bus, then the message packet and information contained therein is processed by the receiving unit, more particularly the receiving unit CPU 122, steps 708, 710. More specifically, the receiving unit CPU 122 processes the transmitted vehicle location information (e.g., latitude and longitude grid information) so as to determine an estimated time of arrival (ETA) and a distance, and once determined the ETA and distance associated with the current message is displayed by the receiving unit, steps 712, 714.

Once the learn data tables are completed for a given bus stop, an algorithm is employed to determine and display the ETA information. The algorithm is based on the premise that the bus behaves similarly each day and also that the time it takes the bus to get to the bus stop from a particular location also should be similar each day. According to the most general aspects of this technique, the algorithm compares the current position information in the message with the position data in the learn table. The data is compared and a point from the learned data that best fits the location information of the current message is identified and the ETA minutes associated with this point of the learn data table is displayed and used as the ETA for the current message. In other words, if the locations do not match exactly the algorithm determines the position in the learn table that best represents the location of the vehicle at the time of transmission. In this way, the ETA being displayed at any given time is the number of minutes the vehicle should take to get from a given point to the desired location based on historical information acquired for example, during the learning process of the time it took for the vehicle previously to travel from the given point or a best fit position for the given point to the desired location.

This algorithm is beneficial in that if a bus is stuck in traffic, and even though the learned data it is comparing against did not, the ETA time displayed will not continue to count down. In the opposite scenario, where a bus did not stop even though there is a stop in the learned data it is being compared against, the ETA will move down faster than that in the learn table as the bus comes upon better fit coordinates that have lower ETA times associated with it. The algorithm is updated every time a new location coordinate is reached, so the algorithm is especially flexible in counting down slower or faster to maintain accurate ETA time. In this way, the system can easily and quickly adjust ETAs based on actual driving conditions without having to know or access the particular impact of such driving conditions on the travel speed and thus travel time of the vehicle.

In a more specific embodiment, the algorithm is further modified to provide a mechanism for dealing with buses that loop around and double back on coordinates, for dealing with buses that bypass pickup points to each one and of their route, instead of picking children up on the way back, and for handling detours that are sometimes taken if roads are closed or if traffic problems are encountered. To address the first two scenarios, narrow windows are viewed in the learning table. For example, the first message heard from a bus in the morning is assumed to best match with the first row entry in the learning table. To ensure that this is the best fit, other learned entries around this point are also viewed. Whichever point is determined to be the best fit (i.e., based on the shortest distance between the current message location and those stored in the learn table) is stored as the current index point. When the next bus message is received, the next row entry in the learned table is assumed to be the best fit, and points around it are examined to be the best fit. To address the cases where a bus diverges from its normal route, a recover algorithm is employed. The recover routine is called when the distance between learn points in the current bus location exceeds a certain distance (i.e., points not matched well) or if the data trends start to exhibit irregular patterns.

The above described ETA algorithm is best understood with reference to the following discussion when viewed with the table provided in FIG. 6, where relevant indicator entries in the data table and columns indicate new bus message coordinates received. The black boxes show the various narrow windows that are examined and a highlighted cell shows a best fit (closest distance). In the illustrated tabulation, a diagonal trend is seen, where a perfect match of the learned data and the current bus data would exhibit a perfect diagonal. If the algorithm trend falls to far off of this diagonal, then the recovery routine is called too.

The distance associated with the current bus message is calculated using the stored bus stop location information of the bus stop and the location information provided from the bus message. The following example illustrates the calculational process to calculate distance when the above described grid coordinate system is used.

$$\text{Distance}=15*\text{sq. root}[(\text{bus lat grid}-\text{ref lat grid})^2+(\text{bus long grid}-\text{ref long grid})^2]/4096$$

In the case where the receiving unit 120 is connected to a communications network such as that shown in FIG. 1B so as to form a network of receiving units (e.g., a wide area network), each receiving unit of the network transmits the received message into the communication network so that is available to all of the receiving units and/or systems connected to the communication network, step 711 (YES or NO, step 709). If the receiving unit is continuously powered, such messages being transmitted can include messages being transmitted by other buses in range of a given receiving unit. In an alternative embodiment, the receiving unit 120 determines the device or apparatus where the received message should be transmitted to as well as the network address for such device or apparatus and then transmits the received message to the network address for such device or apparatus. In the case where the receiving module 122 is being powered up only at those times when a message is expected to be transmitted by a specific bus, then the message being transmitted into the communication network may only be that coming from the specific bus the given receiving unit is tracking.

When the message is received by the device or apparatus that should process the message as herein described, that device or apparatus when it receives such message as part of the message evaluation process also checks to see if the message transmitted by the network was already received by such device or apparatus, such as by means of the RF receiver connected thereto. In such case, such device or apparatus does not process the duplicative or repetitive message(s) further. In an alternative embodiment, the receiving unit 120 determines the device or apparatus where the received message should be transmitted to as well as the network address for such device or apparatus and then transmits the received message to the network address for such device or apparatus. If it is determined that the message communicated via the network is not duplicative or repetitive, then such device or apparatus processes the message as if it were received via the RF receiver.

In further embodiments, the CPU of each receiving unit of the network initially and periodically communicates over the network to determine a synchronization time and to adjust the time or clock for the receiving unit so as to thereby synchronize the time or clocks of all of the receiving units of the network. In an illustrative example, each CPU connects via the communications network to a website of the world-wide web which website provides a time signal such as that provided for example by an atomic clock. In this way, the timing of messages being received and transmitted via the network can be used to determine if the received message is a duplicative or repetitive message.

After determining the distance and ETA (steps 712, 714), the receiving unit CPU 122 evaluates either or both of the determined information to determine if an alarm threshold has been reached, step 716. If the threshold criterion is satisfied (YES, step 716) an alarm is set, step 718. As indicated above, the alarm can be either a visual or auditory alarm. After setting the alarm or if the threshold criterion is not satisfied (NO, step 716), the receiving unit CPU 122 determines if the bus is at the location of the bus stop, step 720. If the bus is at the bus stop (YES, step 720) and the receiving unit 120 is not being continuously powered (NO, step 703), then the receiving module 138 is powered down and the receiving unit proceeds to determine if it is the call time for the next bus. In other words, the process returns to step 704.

If the bus is not at the bus stop (NO, step 720) and the receiving unit 120 is not being continuously powered (NO step 703'), then the receiving module 138 is powered down, step 722, and the receiving unit proceeds to determine if it is the call time for the next bus. If the bus is not at the bus stop (NO, step 720) and the receiving unit is continuously powered (YES, step 703'), then the process returns to step 708. In this way, the receiving unit can receive and transmit any messages it receives from other buses via the communications network while awaiting the arrival of the call time for the next bus.

Figure 5E:
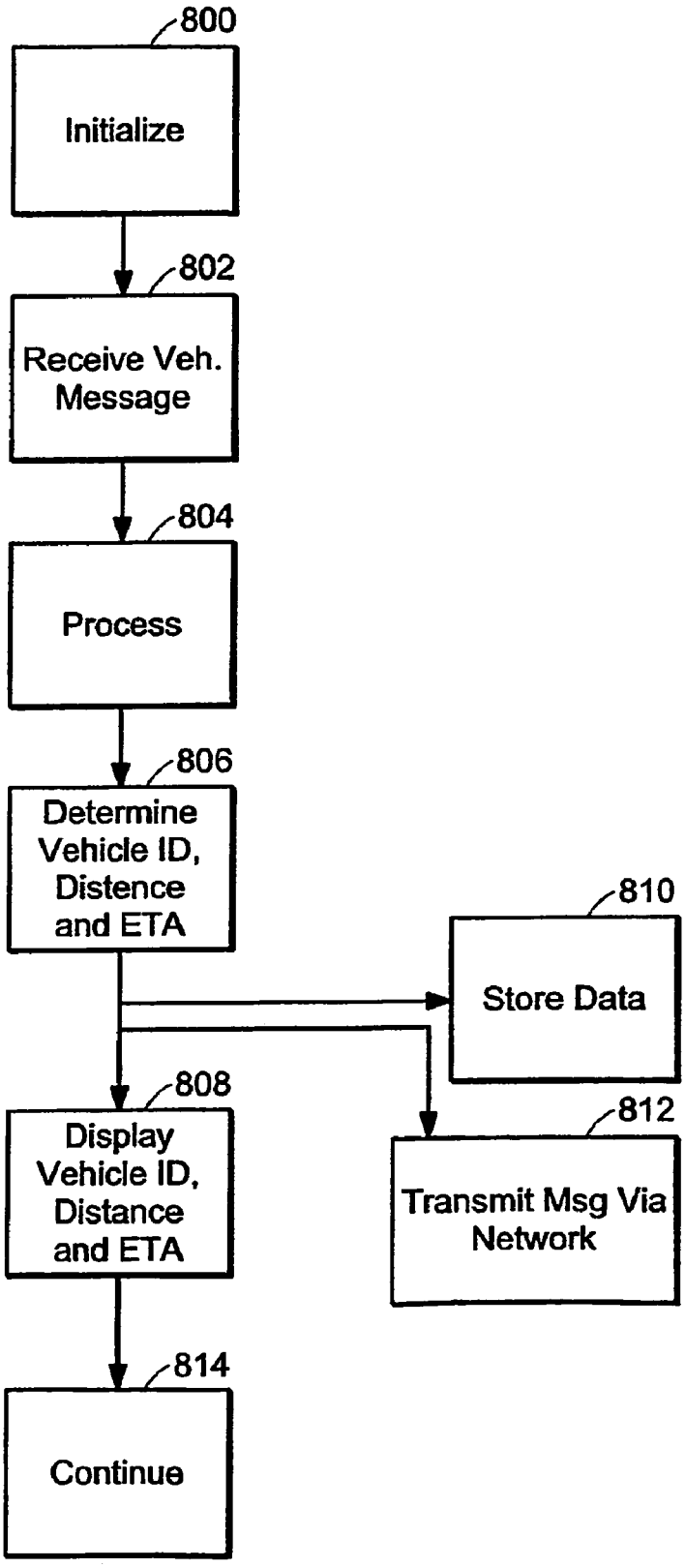
FIG. 5E is a flow diagram illustrating a process for determining and displaying information relating to vehicle travel with respect to the destination/delivery site including determining ETA for vehicles arriving at the destination/delivery site.

Now referring to FIG. 5E there is shown a flow diagram of the process employed by the destination/delivery site receiving system 220 in determining estimated time of arrivals and other information for each vehicle that is to arrive at the destination/delivery site. For this application, the destination/delivery site receiving system 220 is typically continuously powered and thus is capable of receiving transmissions from any bus at any time. It is within the scope of the present invention, however, for this unit to be configured and arranged so as to be capable of receiving transmissions during those times when a transmission is to be made by a vehicle that is arriving at the destination/delivery site and to be powered down and such other times.

Before the destination/delivery site receiving system 120 is used in a particular application, the receiving system is initialized, step 800. Such initialization mainly comprises performing the learning operation described in connection with FIG. 5B as hereinabove described. However, it is not necessary for the unit to learn the location of the stop as the location of the destination/delivery site can be predetermined and inputted into the destination/delivery site receiving system 220. Reference also should be made to the discussion regarding steps 708, 712, 710, 714 of FIGS. 5C-D, for further details regarding steps 802, 804, 806 of FIG. 5E.

After determining the vehicle identification, ETA and distance, the computer's CPU 232 causes this information to be displayed on the display unit 223 and also for such information to be stored in the computer's storage device 231 as hereinabove described, steps 808, 810. In the case where the destination/delivery site receiving system 220 is connected to a communications network such as that shown in FIG. 1B so as to form a network of receiving units and/or systems (e.g., a wide area network), the computer's CPU 232 also causes each received message to be transmitted into the communication network so that each message is available to all of the other receiving units/systems connected to the communication network, step 812. See also the discussion above regarding step 711 of FIG. 5C as to alternate embodiments, processing of signals transmitted via the network and time synchronization of the clocks or time of all units connected to the network. The foregoing process is continued, step 814. In addition, and as more particularly described in connection with FIG. 5F, the computer's CPU 232 also can be configured and arranged so as to be able to take all of the locational information for one or more buses and to map the travel route of these one or more buses. Further, such mapping can be displayed on the display unit 223 such as that shown in FIGS. 7A,B.

According to another aspect of the present invention, there is featured a vehicle locating or tracking system that monitors, tracks and/or maps the location of in-transit vehicles, more particularly a system in which such monitoring and tracking is done in or essentially in real-time. The operation of such a real-time tracking, monitoring and mapping system, methodology and applications program embodying such a methodology can be best understood with reference to the following discussion when taken in connection with FIG. 5F and FIGS. 1A,B and FIG. 3E.

Figure 5F:
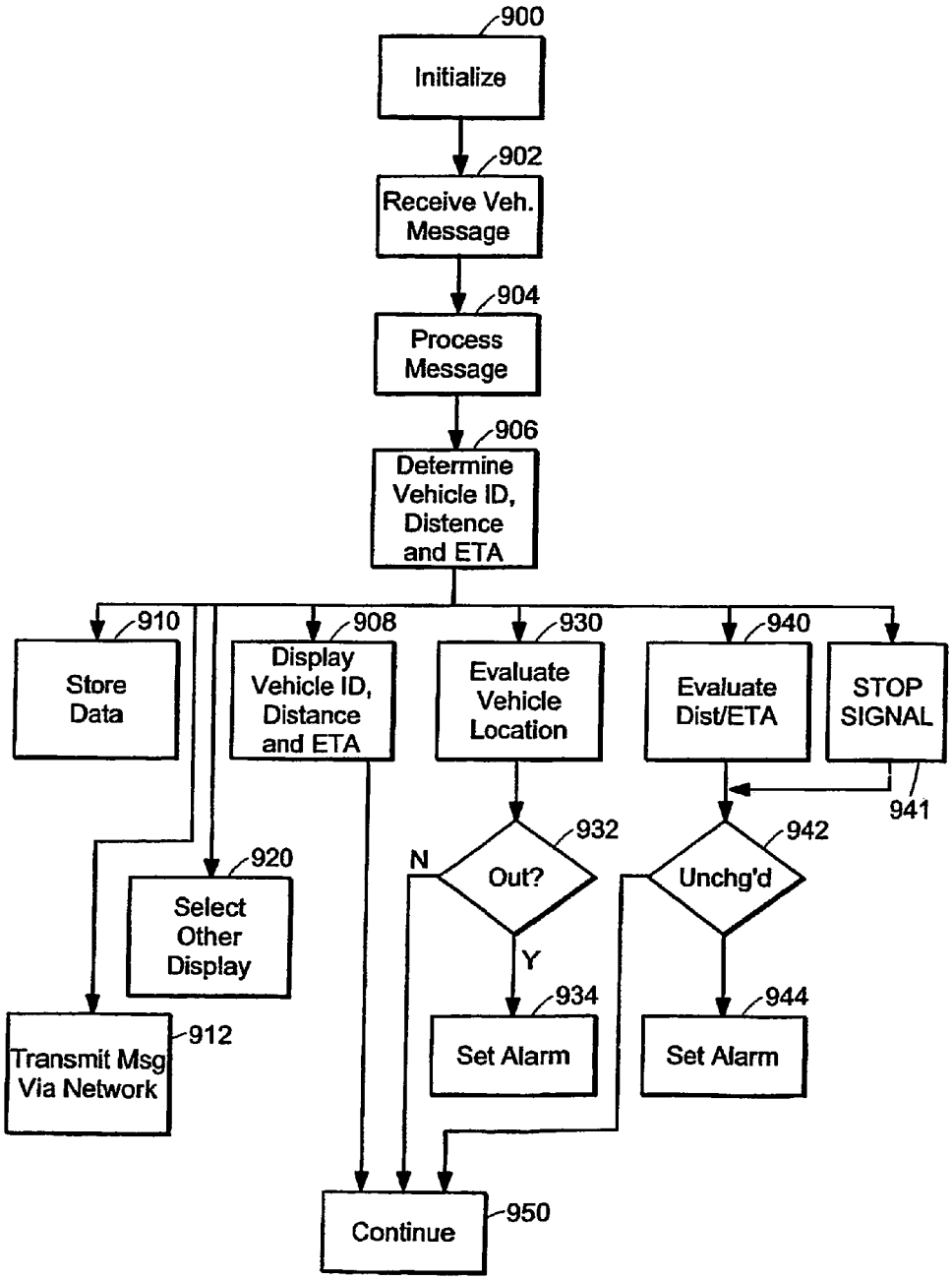
FIG. 5F is a flow diagram of the process for determining and displaying information used in connection with real-time mapping and monitoring of in-transit vehicles.

Now referring to FIG. 5F there is shown a flow diagram of the process employed by the receiving and monitoring system 320 according to the present invention. This particular receiving system is more particularly configured and arranged to receive transmissions from in-transit vehicles so as to locate each of these vehicles for monitoring vehicle movement and, in more particular embodiments, performing a real-time mapping of vehicle movement as well as determining if such movement indicates an abnormal condition. For this application, the receiving and monitoring system 320 is typically continuously powered and thus, is capable of receiving transmissions from any vehicle/bus at any time. It is within the scope of the present invention, however, for this unit to be configured and arranged so as to be capable of being selectively powered.

Before the receiving and monitoring system 320 is used in a particular application, the receiving system is initialized, step 900. Such initialization mainly comprises performing the learning operation described in connection with FIG. 5B as hereinabove described. However, it is not necessary for the unit to learn the location of a stop as the receiving and monitoring system is monitoring vehicle movement in general. Also, and as indicated above, the location of destination/delivery sites can be predetermined and inputted into the receiving and monitoring system 320 so that the arrival time (ETA) of each vehicle at the destination/delivery site can be easily determined, as hereinabove described. Reference also should be made to the discussion regarding steps 802-812 of FIG. 5E, as well as the related discussion in FIGS. 5C-D, for further details regarding steps 902-912 of FIG. 5E.

Figure 7A:
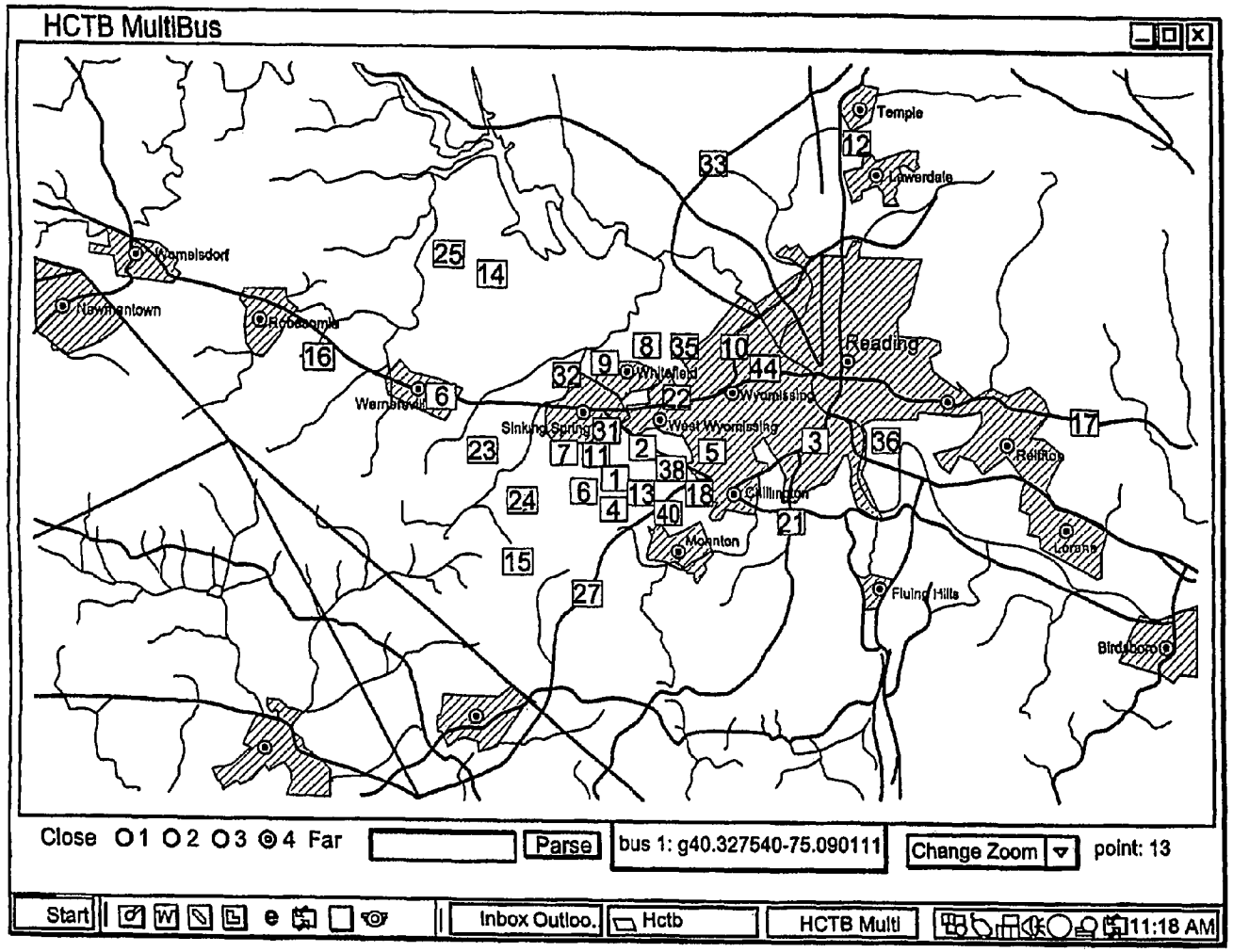
FIG. 7A is an exemplary screen display illustrating real-time mapping of all vehicles in-transit in an area.
Figure 7B:
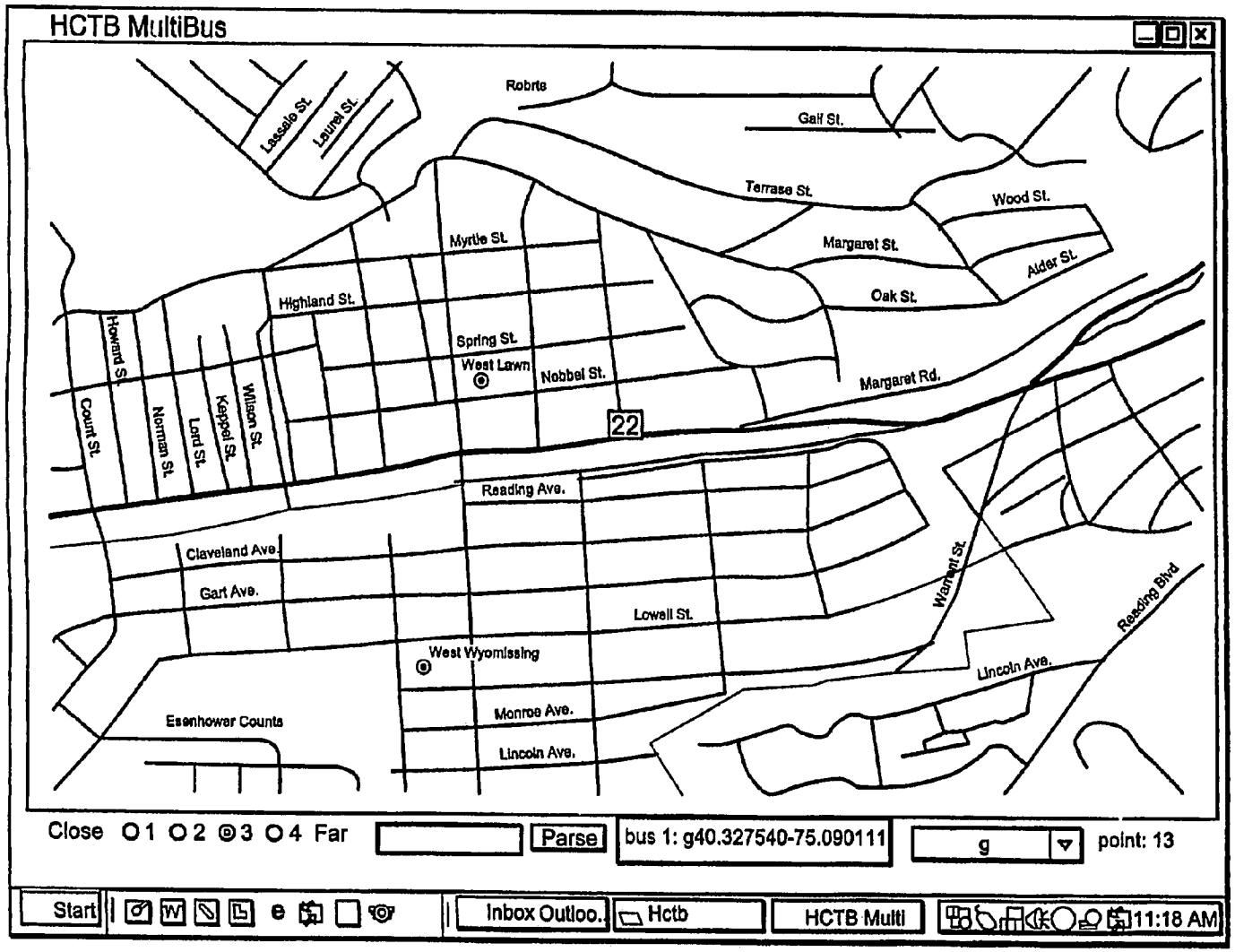
FIG. 7B is another exemplary screen display illustrating real-time mapping of a vehicle in-transit in an localized area, for example a street.

As noted above, the receiving and monitoring system CPU 322, more specifically the application program being executed in the CPU, receives a message packet from the transmission apparatus 160 and uses the location information provided in these message packets to determine where the vehicle is located in a predetermined area, step 920, which determination can be quickly and easily displayed. Also, the stream of message packets being received from the transmission apparatus of each vehicle is used by the CPU 322 to map out and/or determine the travel path/route of each in-transit vehicle within the predetermined area. In more particular embodiments, this tracking, monitoring and mapping is performed in real time. In more specific embodiments, a track or travel route for the vehicle is overlaid onto a map of the local area so a user can determine what street the vehicle is on. There is shown in FIG. 7A an exemplary screen display illustrating such mapping of all vehicles in a given area and an exemplary screen display illustrating such mapping of a single vehicle is shown in FIG. 7B.

As indicated above, in embodiments of the present invention the receiving and monitoring system CPU 322 includes instructions and criteria for evaluating vehicle location, the determined distance and/or ETA of any in-transit vehicle to identify abnormal conditions. In one particular embodiment, a safe travel area is set and/or defined about the travel route for a given vehicle in which the vehicle can depart from the normal travel route because of road construction, car accidents and the like while also setting a travel limit beyond which vehicle travel should not normally occur. In accordance with this embodiment, the receiving and monitoring system CPU 322 evaluates the location information being transmitted by each in-transit vehicle to determine the real-time position of the vehicle with respect to the travel route and the safe travel area about the travel route being traveled, step 930.

The CPU 322 further evaluates the real-time position to determine if the real-time position of the vehicle is within or outside the safe travel region, step 932. If the vehicle is within the safe travel area (NO, step 932), the CPU monitoring and evaluation process hereinabove described is continued, step 950. However, if the vehicle is determined to be outside the safe travel area, an alarm is set, step 934. This alarm can be visual or auditory in form. In this way, a vehicle departure from the normal travel route that might be an indicator of a potential problem can be identified in some cases well before the vehicle ETA at a destination/delivery site would have run.

In addition, the real-time monitoring and locating capabilities of the system can be used to assist the responsible authorities or police to catch up to the vehicle. In another embodiment, criteria is set to limit the amount of time a vehicle will be allowed to remain at rest (i.e., not moving) so as to provide an indication of the potential mechanical problem or other traffic condition causing the vehicle to be delayed. In accordance with this embodiment, the receiving and monitoring system CPU 322 evaluates the determined distance and ETA of the present and preceding transmission cycles to see if there has been no change, to determine how long the vehicle has not moved and to determine if this amount of time exceeds the established criteria, steps 940, 942. In an alternatively embodiment, the CPU 322 evaluates the message packets to determine if a vehicle stop signal is outputted by the transmission apparatus and to determine if the stop signal being outputted exceeds the established criteria, steps 941, 942. As indicated above (FIG. 2D), the transmission apparatus CPU 162 is operably coupled to the vehicle electrical circuitry and/or electronics to monitor signals, voltages and/or currents thereof to determine a vehicle status or condition, such as for example, the activation of the lighting or other mechanisms associated with stoppage of a vehicle (e.g., emergency flashers).

If the criteria is not exceeded (NO, step 942) then the monitoring and evaluating process as described above continues, step 950. If the criteria is met or exceeded (YES, step 942) then another alarm is set, step 944. In this way potential vehicular problems can be identified before the vehicle ETA at a destination/delivery site would have run. In addition, the real-time monitoring and locating capabilities of the system provide a mechanism to identify the location of the vehicle that is stopped for the responsible authorities or police being dispatched.

Figure 5G:
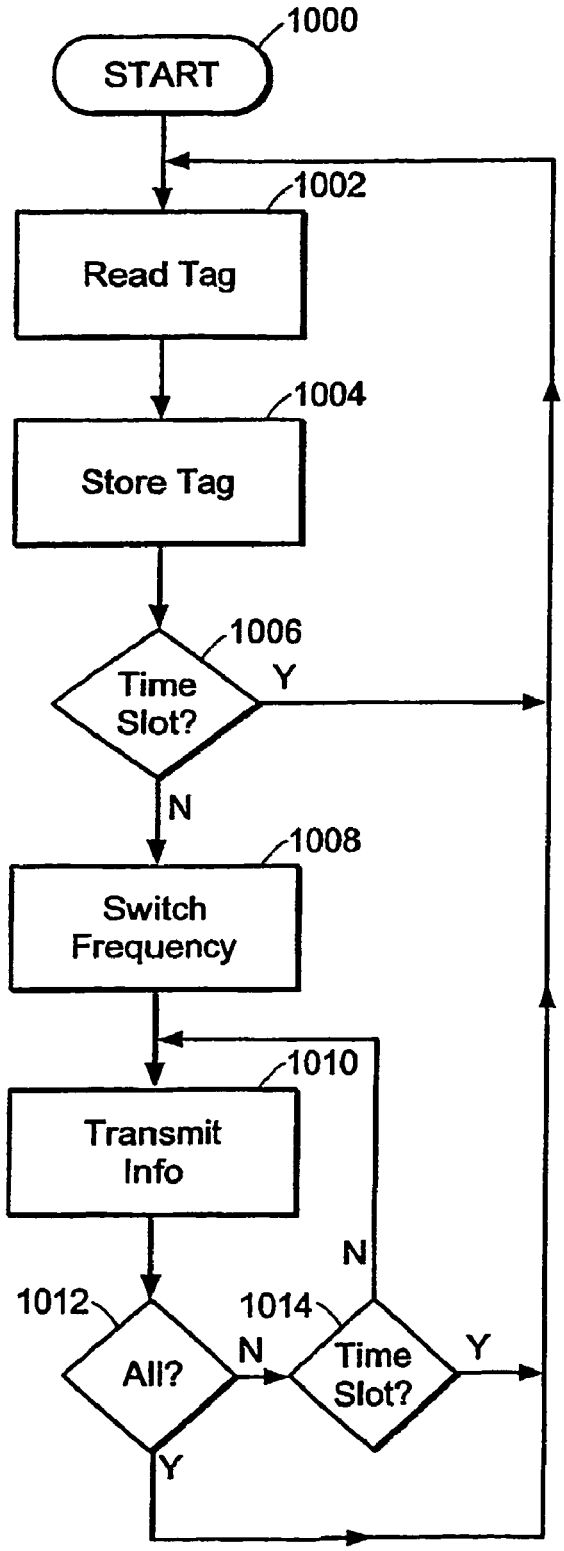
FIG. 5G is a flow diagram of the process for transmitting non-location information from an in-transit vehicle.

There is shown in FIG. 5G a flow diagram illustrating the process for transmitting non-location information from the bus/vehicle to the destination/delivery site receiving system 220 or the receiving and monitoring system 320. According to this embodiment or aspect of the present invention, information unrelated to the location of the vehicle is obtained or available at the vehicle level and is preferably transmitted in manner so as to not interfere with the transmission of location information. This methodology can be best understood from the following exemplary embodiment taken in conjunction with FIG. 5G.

As indicated above, according to an aspect of the present invention vehicle passengers, such as students, are provided with a device or mechanism that can produce an RF or optical image or output signal that uniquely identifies each passenger as they board the vehicle such as a school bus. One example of such device or mechanism is a passive RFID tag that provides an RF signature upon entering an electrical field emitted by an RFID transceiving unit/card reader. Another example of such a device or mechanism is a tag, label or other plastic or paper structure containing a bar code form of label that can be read by an optical scanning type of device. The tag reader 165 is any of a number of devices known to those skilled in the art that is appropriate for use with such a device or mechanism to obtain the RF or audio signal output and optical signal representative of the bar code label or other such optical coding format. For example, the tag reader 165 would be a transceiver that emits an electrical or magnetic field such that a passive tag identification is then received back, thereby identifying the person carrying the tag. The identification system could be RF based or one of a number of known optical scanning devices used in the art for scanning bar code labels and providing an output signal representative thereof.

Thus, and after starting the trip, step 1000, when the vehicle arrives at a passenger pick-up point, such as a school bus stop (FIG. 1A) the device or mechanism provided to the passengers hereinafter passenger tag) is read by the tag reader 165 (FIG. 2D), Step 1002. The transmission apparatus CPU 162 takes the read information and stores this information for transmission, Step 1004. In an illustrative example, the passenger is a student and the information being read uniquely identifies the student boarding the school bus.

Thereafter, the CPU 162 determines if it is time to make a transmission of vehicle location information, Step 1006. In other words, the CPU determines if it is the time slot for the given transmission apparatus. If it is time to make such a transmission (YES, Step 1006) the CPU 162 continues the process and is limited to reading tags 1002. If it is not time to make such a transmission, and there is stored information, the CPU 162 changes the transmission frequency of the transmitter 166*a* so that any transmission therefrom occur on a transmission frequency that is different from the frequency on which vehicle location information is transmitted, Step 1008.

The CPU 162 retrieves the stored information and transmits the stored information, Step 1010. In particular, the CPU 162 transmits the information at a time that is different from the time vehicle location information is transmitted. For example, if the time slot for the vehicle occurs in the first 2 seconds of a 10 second time interval, the non-location information is transmitted sometime after 2 seconds. After sending each information packet, the CPU 162 determines if all of the information has been transmitted, Step 1012. If all of the information has been transmitted (YES, Step 1012), the process continues by reading additional passenger tags.

If all the information has not been transmitted (NO, Step 1012), the CPU 162 again determines if it is time to make another vehicle location transmission, Step 1014. If not, the CPU 162 causes the next packet of information to be transmitted. If it is time for such a transmission, the CPU 162 switches the transmitter frequency back to the frequency for outputting vehicle location information. In further embodiments, the time interval for transmission (e.g., the 10 second time interval) is divided into time segments. In this embodiment, transmission of non-location information from time slots located in a prior segment is controlled so as to occur only in the time segment that immediately follows.

Although FIGS. 1A,B illustrate the receiving and monitoring foregoing describes the receiving and monitoring system 320 as being located at a central dispatch location this shall not be construed as limiting the tracking, monitoring and/or mapping system, related methodology and applications program of the present invention. As indicated above, it is within the scope of the present invention for the tracking, monitoring, mapping and/or alarm functionalities of such a system to be incorporated into and embodied in the destination/delivery site receiving system 220 at each destination/delivery sites. In this way, the real-time tracking and monitoring of in-transit vehicles is performed at the location where the vehicle is expected to arrive and thus such tracking and monitoring is in effect distributed through out the entire vehicle transportation system.

Figure 1C:
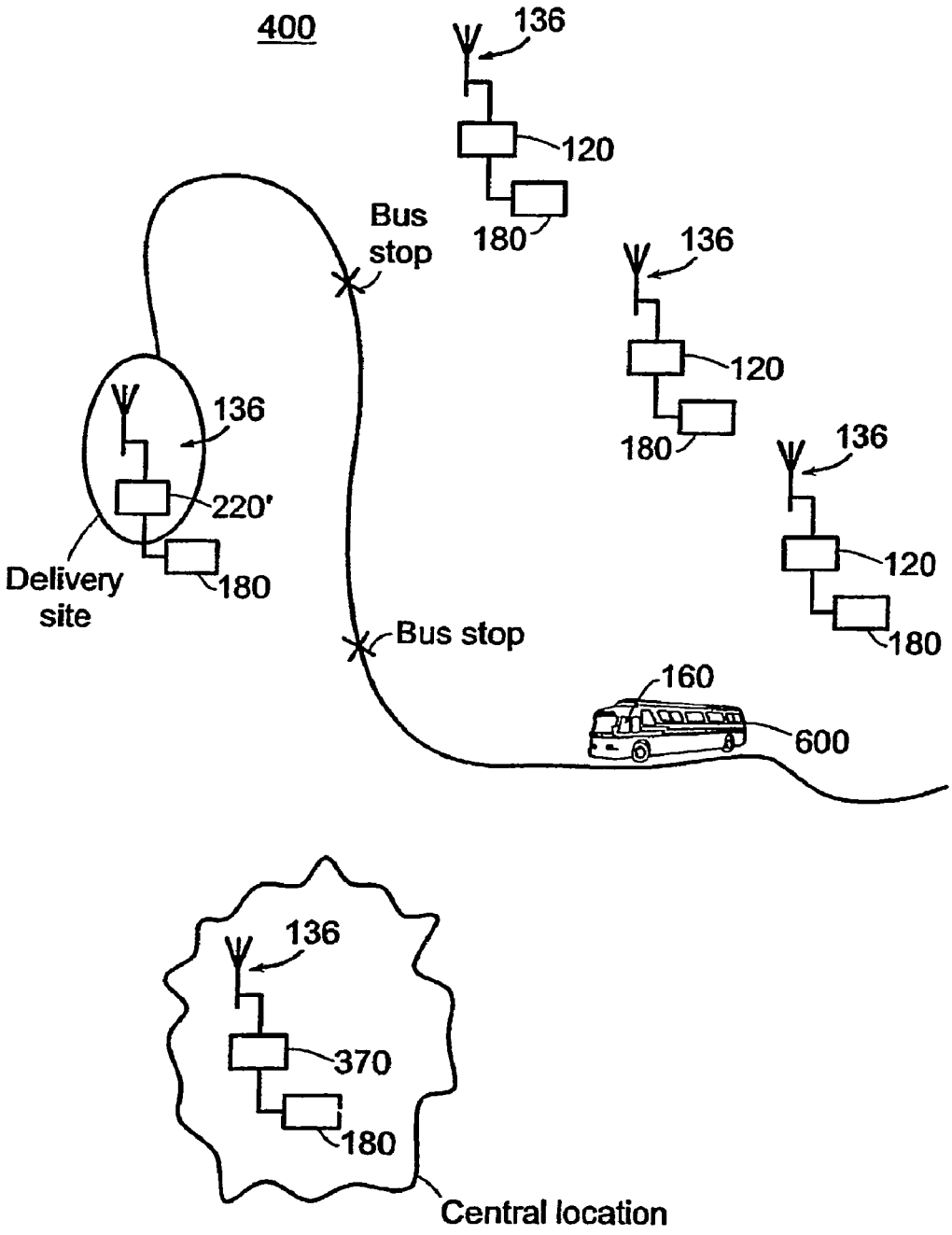
FIG. 1C is an illustrative view of a tracking and monitoring system according to yet another aspect of the present invention embodying a communications network.

In addition, and with reference to FIG. 1C, there is shown an illustrative view of a tracking and monitoring system 400 of yet another embodiment in which a plurality of receiving units are distributed throughout the transportation system and arranged so as to provide a distributive communications network for receiving the vehicle location information messages from any in-transit vehicle with a predetermined area. Each of these receiving units are operably and communicatively coupled to a communications infrastructure, embodying wireless and/or non-wireless communication techniques. The CPU 122 of each of the receiving units includes an applications program that controls the receipt of such vehicle location information messages or other information, determines the device/apparatus/system to which the received information should be directed and the network associated address for such a device/apparatus/system and transmits the received information thereto.

The device/apparatus/system to which the information is directed including the above-described destination/delivery site receiving system 220 configured and arranged so as to include tracking, monitoring and/or mapping capability and/or a receiving and monitoring system 320 processes the received information as herein described. In particular, the information communicated via the communications network is evaluated on receipt to determine if it is duplicative or repetitive with another received message communicated via the network or received directly via the receiver. As indicated above, messages that are not duplicative or repetitive are processed as if the message had been received directly from the vehicle transmission apparatus.

Figure 8:
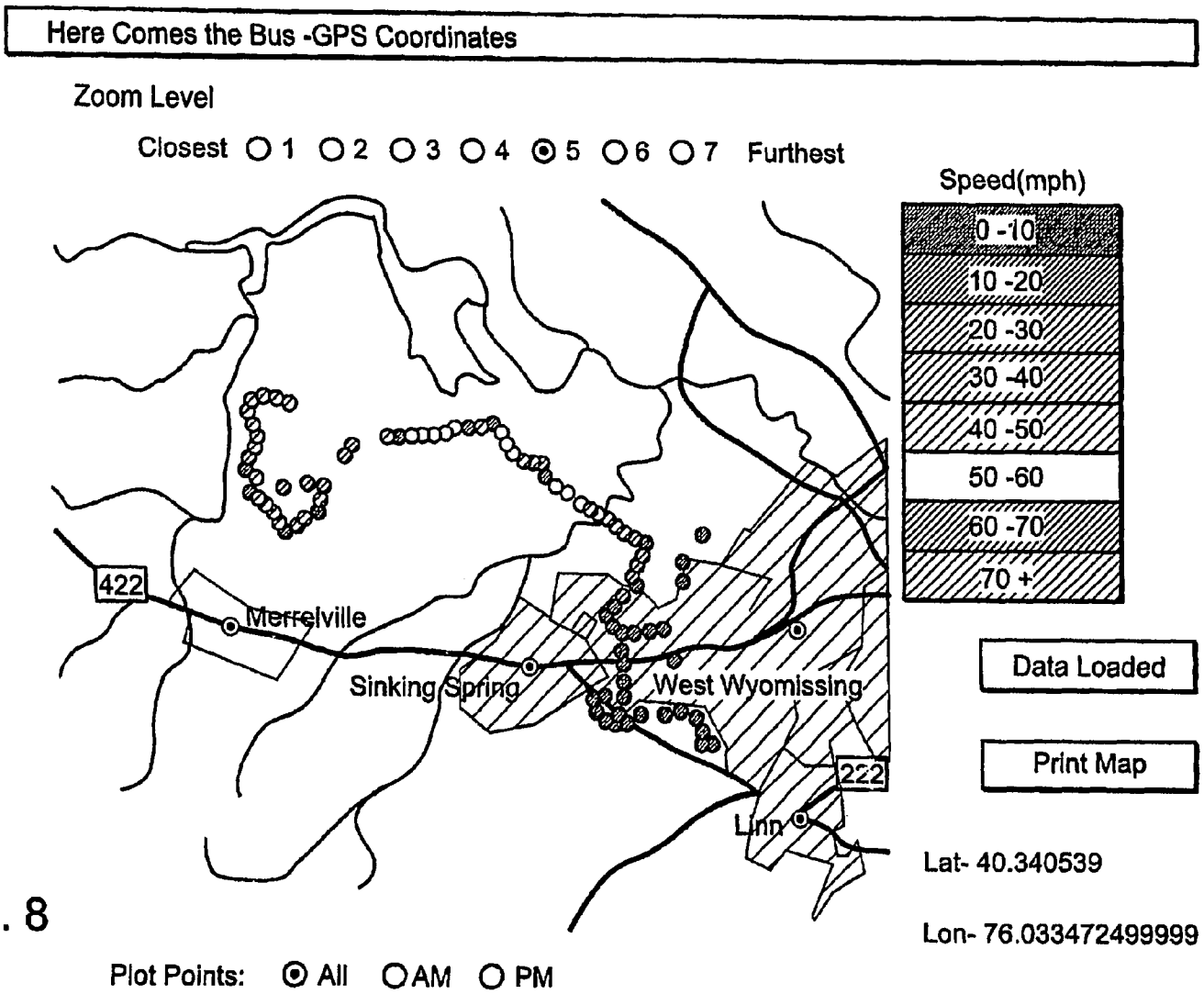
FIG. 8 is an example of a vehicle track plot where the vehicle route is indicated by circles, and where the shading of the circle indicates vehicle speed.

Now referring to FIG. 8, and as indicated elsewhere herein, in a specific embodiment of the present invention, vehicle log files are downloaded from the vehicle transmission apparatus to a personal computer (PC) and include data on where the corresponding vehicle has been and the speed of the vehicle along its route. The PC includes the means to process the information included in a vehicle log file to generate a corresponding vehicle track plot wherein the location and speed of the bus at each vehicle log file entry is transferred to a map or graphical representation of the vehicle route. A symbol or alphanumerical character marks vehicle location. Vehicle speed is expressed graphically according to a specified legend by either coloring, shading or otherwise marking the location symbols or alphanumerical characters with the appropriate marking from the speed legend. A circle graphically represents the vehicle location for each vehicle log file entry and vehicle speed is represented by grayscale shading the corresponding location circle according to the "Speed in m.p.h." legend. Alternatively, several vehicles can be displayed in one vehicle track plot whereby each vehicle is identified by different marker morphologies.

In another specific embodiment of the present invention, a website can provide a central location for assisting with the distribution of information regarding vehicle operations wherein the website includes integrated informational screens displaying vehicle log files and vehicle track plots corresponding to individual vehicle route numbers and dates. Passengers and vehicle operators can access information included on the website to conveniently monitor vehicle activities. In addition, the website can also allow bus operators to provide passengers with estimated delay times for bus routes. The website is then linked to a toll-free number so users can easily access the information. This website function is particularly important when a receiver fails to go off in the expected time period for a bus pickup whereby the parents can call the toll-free number or access the website to investigate the delay.

While such a preferred embodiment of the present invention involves the advanced notification of school bus arrival at a bus stop, this notification system has many other applications that include, but are not limited to the following examples. Notifying hospitals of an approaching ambulance carrying severe trauma patients that require immediate attention thereby minimizing inactive waiting periods in an ER. Emergency rescue situations wherein a disabled vehicle or individual activates a transmitter to assist search efforts by rescue parties. Parents can generate a car track plot of where a car equipped with a transmitter has been and at what speeds it was monitor the driving habits of their children. Rental car companies can equip their cars with transmitters to facilitate locating rental cars in parking lots and to provide advanced notification of a rental car return.

Although a preferred embodiment of the invention has been described using specific terms, such description is for illustrative purposes only, and it is to be understood that changes and variations may be made without departing from the spirit or scope of the following claims.

What is claimed is:

1. A method for determining an arrival time of a vehicle at one or more locations along the travel route for the vehicle comprising the steps of:

generating a table including locations of the vehicle in a time sequence as the vehicle approaches each of the one or more locations and an ETA corresponding to each location;

transmitting signals periodically from the vehicle, each signal including information of vehicle location at the time of transmission; and determining an arrival time for each transmitted location using the time sequenced location and ETA in the table.

2. A method for determining an arrival time of each of at least one in-transit vehicle at one or more locations along the travel route for each of the at least one vehicle comprising the steps of:

generating a table including locations of each of the at least one in-transit vehicles in a time sequence as each of the at least one vehicle approaches each of the one or more locations and an ETA corresponding to each location;

establishing a unique signal transmission time slot for each of the at least one in-transit vehicle;

transmitting signals periodically from each of the at least one in-transit vehicle during the unique signal transmission time slot established far said each of the at least one in-transit vehicle, each signal being transmitted including location information of said each at least one in-transit vehicle at the time of transmission;

determining an arrival time for each of the at least one vehicle from the location information transmitted during the time slot for said each of the at least one in-transit vehicle using the time sequenced location and ETA corresponding to said each of the at least one in-transit vehicle in the generated table.

3. The method of claim 2, wherein there are a plurality of vehicles in-transit at any one time and wherein said generating includes generating a table that includes locations of each of the plurality of in-transit vehicles in a time sequence as each of the plurality of in-transit vehicles approaches each of the one or more locations and an ETA corresponding to each location;

establishing a unique signal transmission time slot for each of the plurality of in-transit vehicles;

transmitting signals periodically from each of the plurality of in-transit vehicles during the unique signal transmission time slot established for said each in-transit vehicle, each signal being transmitted including location information of said each in-transit vehicle at the time of transmission;

determining an arrival time for each of the plurality of in-transit vehicles from the transmitted location information for said each in-transit vehicle using the time sequenced location and ETA corresponding to said each in-transit vehicle in the generated table.

4. The method of claim 2, wherein said establishing includes establishing a unique time slot for each of the at least one in-transit vehicle so as to minimize signal collision.

5. The method of claim 2, wherein said establishing includes synchronizing the timing signals for signal transmission for each of the at least one in-transit vehicle.

6. The method of claim 2, wherein a predetermined area in which the at least one in-transit vehicle travels is divided into at least two regions, and wherein said establishing establishes a unique time slot for each of the at least two regions.

7. The method of claim 2, further comprising the steps of:

establishing another time slot for each of the at least one in-transit vehicle and being at a different time said established time slot; and transmitting non-location information from each of the at least one in-transit vehicle during said another time slot.

8. The method of claim 7, further comprising the steps of:

establishing a first transmission frequency for transmission of location information and a second transmission frequency for transmission of non-location information; and wherein said transmitting includes transmitting location information using the first frequency during said established time slot and transmitting non-location information using the second frequency during said another established time slot.

9. A method for real-time tracking of at least one vehicle that is in-transit in a predetermined area comprising the steps of:

providing a plurality of signal receiving devices disposed throughout a region including the predetermined region so as to be capable of receiving signals being generated within the predetermined area;

establishing a communications network operably interconnecting each of the plurality of signal receiving devices;

transmitting signals periodically from each of the at least one in-transit vehicle, each signal being transmitted including location information of said each at least one in-transit vehicle at the time of transmission;

receiving each of the periodically transmitted signals at one of the plurality of provided receiving devices; and determining if the receiving device receiving said each of the periodically transmitted signals is the processing receiving device that is to process the transmitted signal.

10. The real-time tracking method of claim 9 further comprising the steps of:

forwarding said each of the periodically transmitted signals to one of the plurality of receiving devices in the case where said determining determines that the device that received the signal is not the processing receiving device; and processing said each of the periodically transmitted signals in the case where said determining determines that the device that received the signal is the processing receiving device, wherein said processing includes processing each of said each of the periodically transmitted signals for said at least one in-transit thereby tracking the movement of the at least in-transit vehicle within the predetermined area.

11. A system for real-time tracking of at least one vehicle that is in-transit in a predetennined area, comprising:

a signal transmission device for each of the at least one in-transit vehicle, each of said signal transmission devices including a transmitter, a microprocessor operably coupled to the transmitted and an applications program for execution on the microprocessor;

a plurality of signal receiving devices disposed throughout the predetermined area so as to be capable of receiving signals being generated within the predetermined area;

a communications network operably interconnecting each of the plurality of signal receiving devices; and wherein said applications program including instructions and criteria for:

transmitting signals periodically from the transmitter, each periodic signal being transmitted including location information of said at least one in-transit vehicle at the time of transmission, and determining the location of the in-transit vehicle at the time of trasnmission.

12. The real-time tracking system of claim 11, wherein each of said signal receiving devices includes a receiver, a microprocessor operably coupled to the receiver and an applications program for execution on the microprocessor; and wherein said applications program includes instructions and criteria for:

receiving each of the periodically transmitted signals at one of the plurality of provided receiving devices, and determining if the receiving device receiving said each of the periodically transmitted signals is the processing receiving device that is to process the transmitted signal.

13. The real-time tracking system of claim 12, wherein said applications program includes instructions and criteria for:

forwarding said each of the periodically transmitted signals to one of the plurality of receiving devices in the case where said determining determines that the device that received the signal is not the processing receiving device; and processing said each of the periodically transmitted signals in the case where said determining determines that the device that received the signal is the processing receiving device, wherein said processing includes processing each of said each of the periodically transmitted signals for said at least one in-transit thereby tracking the movement of the at least in-transit vehicle within the predetermined area.

14. The real-time tracking system of claim 13, further comprising a computer system operably coupled to the communications network and remote from the plurality of receiving units, said remotely located computer system including an applications program for accessing vehicle location and non-location information.

15. The real-time tracking system of claim 14, wherein the remotely located computer system is not operably coupled to a receiver so as to directly receive information signals from any of the transmission devices.

16. The real-time tracking system of claim 11, wherein:

a unique time slot is defined for transmission of each periodically transmitted signal from the transmission device of each of the at least one in-transit vehicle and the applications program for execution on the microprocessor of the signal transmission device for each of the at least one in-transit vehicle further includes instruction and criteria for controlling the corresponding transmitter so that signals are transmitted there from only during the unique time slot.

17. The real-time tracking system of claim 11, wherein:

non-location information is transmitted from each of the at least one in-transit vehicle, and the applications program for execution on the microprocessor of the signal transmission device for each of the at least one in-transit vehicle further includes instruction and criteria for controlling the corresponding transmitter so that non-location information signals are transmitted there from at a time different from the unique time slot.

18. The real-time tracking system of claim 17 wherein the non-location information being transmitted includes at least one of driver identification information or vehicle passenger identification information.

* * * * *